US010619406B2

(12) United States Patent
Campbell

(10) Patent No.: US 10,619,406 B2
(45) **Date of Patent: *Apr. 14, 2020**

(54) SECURITY PANEL FRAMING SYSTEM AND METHOD

(71) Applicant: Brad Campbell, Huntington Beach, CA (US)

(72) Inventor: Brad Campbell, Huntington Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/409,711

(22) Filed: May 10, 2019

(65) Prior Publication Data

US 2019/0264495 A1 Aug. 29, 2019

Related U.S. Application Data

(63) Continuation-in-part of application No. 15/909,935, filed on Mar. 1, 2018, now Pat. No. 10,450,793.

(60) Provisional application No. 62/468,882, filed on Mar. 8, 2017.

(51) Int. Cl.

| | |
|---|---|
| ***E06B 5/10*** | (2006.01) |
| ***E06B 5/11*** | (2006.01) |
| ***E04B 1/98*** | (2006.01) |

(52) U.S. Cl.

CPC . *E06B 5/11* (2013.01); *E04B 1/98* (2013.01)

(58) Field of Classification Search

CPC ..... E06B 5/106; E06B 3/5828; E06B 5/116; E06B 1/34; E06B 5/11; E06B 1/6069; E06B 1/366; E06B 1/28

See application file for complete search history.

(56) References Cited

U.S. PATENT DOCUMENTS

| | | | | |
|---|---|---|---|---|
| 4,187,657 | A | 2/1980 | Sukolics | |
| 5,636,484 | A | 6/1997 | DeBlock | |
| 6,293,049 | B1 | 9/2001 | Shaw | |
| 8,490,350 | B1 * | 7/2013 | Greely | E06B 1/34 52/211 |
| 9,657,513 | B1 | 5/2017 | Kapiloff et al. | |
| 2012/0204504 | A1 * | 8/2012 | Knapp | E06B 3/5828 52/204.63 |

(Continued)

OTHER PUBLICATIONS

Hammerglass Add-On System F, 2015, Forslov, Sweden.
DefenseLite, What is DefenseLite?, 2018, https://www.defenselite.com/what-is-it/.

*Primary Examiner* — Patrick J Maestri
(74) *Attorney, Agent, or Firm* — Cionca IP Law P.C.; Marin Cionca

(57) ABSTRACT

A security panel framing system adapted to be mounted onto a frame having a glass, the system having: a wedge having: an upper wedge lip; a wedge wall extending between a wedge top side and a wedge bottom side; a reinforced wedge end at the wedge bottom side; and a lower wedge lip; a cap adapted to be associated with the wedge, having: a first prong adapted to fit onto the upper wedge lip; a second prong adapted to fit between the lower wedge lip and the reinforced wedge end; and a return flange; wherein the system is assembled together when the cap is associated with the wedge front side; such that the return flange extends underneath the wedge bottom side; such that the wedge is adapted to be associated with a security panel mounted to the frame, such that the security panel protects the glass within the frame.

20 Claims, 16 Drawing Sheets

(56) References Cited

U.S. PATENT DOCUMENTS

| | | | |
|---|---|---|---|
| 2016/0145934 | A1 | 5/2016 | Trott |
| 2016/0298938 | A1 | 10/2016 | Trott |

* cited by examiner

SECURITY PANEL FRAMING SYSTEM AND METHOD

CROSS-REFERENCE TO RELATED APPLICATIONS

This application is a continuation-in-part of and claims the benefit of U.S. Non-Provisional application Ser. No. 15/909,935, filed Mar. 1, 2018, which claims the benefit of U.S. Provisional Application No. 62/468,882, filed Mar. 8, 2017, which are hereby incorporated by reference, to the extent that they are not conflicting with the present application.

BACKGROUND OF INVENTION

1. Field of the Invention

The invention relates generally to security window technology and more particularly to a system and method for upgrading existing windows to be able to withstand attacks and other types of damage.

2. Description of the Related Art

The typical window has a frame in which a glass panel is installed. The glass is typically easily breakable. Banks and other commercial establishments often need windows that can withstand an attack from an intruder or a bullet, for example. Some residents may also wish to upgrade their windows for security or safety purposes.

Some existing framing solutions that address this problem appear to be merely improvised assemblies of existing parts that are openly available on the market, which may result in a window that is not sufficiently strong enough to withstand damage. Further, these improvised assemblies often use only adhesive tape to connect to the existing window frame, which can be problematic because they may potentially fail as a security measure, especially when the existing window frame that is to be protected is not in good condition due to oxidation, failing paint, or corrosion. These assemblies also need to be installed when the temperature is warm to avoid condensation on the window during colder weather, which limits their use for much of the year in certain climate zones. Such improvisations do not appear to be strong enough for the intended purpose of added security or safety in many cases. As a result, there appears to be a high likelihood that such improvisations or assemblies would fail when exposed to a serious attack. Another issue in existing systems for adding a security system to windows is that the bolts or other means for fastening the security system are exposed, which may be aesthetically undesirable for a user, and are made of steel and such materials that may rust and become damaged. The exposed bolts can not only be unsightly, but may also be unstable or easily damaged due to the rust. Additionally, anodized aluminum or other such materials may be preferred by users for the construction of such fasteners, but may not be widely available or available at all.

Retailers, vendors, merchants, or individuals selling or otherwise providing a security system for windows may need to acquire individual portions of the security system in order to sell or provide the security system to others. These providers of the security system may also require different quantities of the base of the frame than they require of the leg of the frame. A solution may be needed for providing these portions of the system separately, since storage may be an issue for users who are left with an excess of the leg portions when more of the base portion is needed, or, another issue may be that parts or materials are wasted.

Some users who wish to install a security panel system to add to the strength of a window or door may prefer or desire to mount the system inside of the window frame, which may be advantageous due to the finished system having a desirable appearance to the user, or due to the user preferring this method of installation. However, some frames, such as doors that have glass in them, may not have a deep enough frame to accommodate pieces or components of an extra or after-market security panel system. A problem may be that a system for installing additional panels for security onto an outer surface of window frames or doors with windows may not be available to users.

Thus, there is a need for a new and improved security panel framing system and method that solves the problems outlined above, and is unique and professional.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a security panel framing system adapted to be mounted onto a surface of a frame having a glass is provided, the security panel framing system comprising: a security panel having: a security panel front side; a security panel rear side; a security panel top side; and a security panel bottom side; a wedge having: a wedge front side, a wedge back side, a wedge top side, and a wedge bottom side; an upper wedge lip at the wedge top side; a wedge wall extending between the wedge top side and the wedge bottom side; a reinforced wedge end at the wedge bottom side; and a lower wedge lip above the reinforced wedge end; wherein the wedge back side is adapted to be associated with the security panel front side; a cap adapted to be associated with the wedge front side, the cap having: a cap top side; a cap bottom side; a cap front side; a cap rear side; a first prong extending outwards from the cap rear side at the cap top side, the first prong being adapted to fit onto the upper wedge lip along the wedge top side, and the first prong having a first length; a second prong adapted to fit between the lower wedge lip and the reinforced wedge end, the second prong having a second length; and a return flange extending outwards from the cap rear side at the cap bottom side, the return flange having a third length, wherein the third length is longer than the first length and the second length; wherein the security panel framing system is assembled together when the wedge back side is associated with the security panel front side, and the cap is associated with the wedge front side; such that the return flange extends underneath the wedge bottom side and the security panel bottom side; such that an open space is created between the return flange and the wedge bottom side together with the security panel; such that the wedge front side is covered by the cap when the cap is associated with the wedge; and such that the security panel is mounted to the frame and protects the glass within the frame. Thus, an advantage may be that a protective security panel can be installed securely against a window or other glass panel and can be custom fit to any size window or glass panel. Another advantage may be that a protective security panel may be installed by mounting components on an outer surface of a window or door frame, which may be a method of installation preferred by some users, and may decrease the amount of components needed for the installation of a security panel framing system. Another advantage may be that the security panel framing system is durable and can withstand damage or attack. Another advantage may be that the appearance of the security panel framing system is seamless and can blend into existing framing, and screw heads are hidden from view to provide a more aesthetically pleasing look. Another advantage may be that bugs, dust, water, or other contaminants may be blocked from entering the system or prevented from damaging the system by the sealant and desiccant.

In another aspect, a security panel framing system adapted to be mounted onto a surface of a frame having a glass is provided, the security panel framing system comprising: a wedge having: a wedge front side, a wedge back side, a wedge top side, and a wedge bottom side; an upper wedge lip at the wedge top side; a wedge wall extending between the wedge top side and the wedge bottom side; a reinforced wedge end at the wedge bottom side; and a lower wedge lip above the reinforced wedge end; a cap adapted to be associated with the wedge front side, the cap having: a cap top side; a cap bottom side; a cap front side; a cap rear side; a first prong extending outwards from the cap rear side at the cap top side, the first prong being adapted to fit onto the upper wedge lip along the wedge top side, and the first prong having a first length; a second prong adapted to fit between the lower wedge lip and the reinforced wedge end, the second prong having a second length; and a return flange extending outwards from the cap rear side at the cap bottom side, the return flange having a third length, wherein the third length is longer than the first length and the second length; wherein the security panel framing system is assembled together when the cap is associated with the wedge front side; such that the return flange extends underneath the wedge bottom side; such that an open space is created between the return flange and the wedge bottom side; such that the wedge front side is covered by the cap when the cap is associated with the wedge; such that the wedge is adapted to be associated with a security panel mounted to the frame; and such that the security panel protects the glass within the frame. Thus, again, an advantage may be that a protective security panel can be installed securely against a window or other glass panel and can be custom fit to any size window or glass panel. Another advantage may be that a protective security panel may be installed by mounting components on an outer surface of a window or door frame, which may be a method of installation preferred by some users, and may decrease the amount of components needed for the installation of a security panel framing system. Another advantage may be that the security panel framing system is durable and can withstand damage or attack. Another advantage may be that the appearance of the security panel framing system is seamless and can blend into existing framing, and screw heads are hidden from view to provide a more aesthetically pleasing look. Another advantage may be that bugs, dust, water, or other contaminants may be blocked from entering the system or prevented from damaging the system by the sealant and desiccant.

In another aspect, a method of installing a security panel on a frame for a glass, using a security panel framing system is provided, the security panel framing system comprising: a security panel having: a security panel front side; a security panel rear side; a security panel top side; and a security panel bottom side; a wedge having: a wedge front side, a wedge back side, a wedge top side, and a wedge bottom side; an upper wedge lip at the wedge top side; a wedge wall extending between the wedge top side and the wedge bottom side; a reinforced wedge end at the wedge bottom side; and a lower wedge lip above the reinforced wedge end; wherein the wedge back side is adapted to be associated with the security panel front side; a cap adapted to be associated with the wedge front side, the cap having: a cap top side; a cap bottom side; a cap front side; a cap rear side; a first prong extending outwards from the cap rear side at the cap top side, the first prong being adapted to fit onto the upper wedge lip along the wedge top side, and the first prong having a first length; a second prong adapted to fit between the lower wedge lip and the reinforced wedge end, the second prong having a second length; and a return flange extending outwards from the cap rear side at the cap bottom side, the return flange having a third length, wherein the third length is longer than the first length and the second length; wherein the security panel framing system is assembled together when the wedge back side is associated with the security panel front side, and the cap is associated with the wedge front side; such that the return flange extends underneath the wedge bottom side and the security panel bottom side; such that an open space is created between the return flange and the wedge bottom side together with the security panel; such that the wedge front side is covered by the cap when the cap is associated with the wedge; and such that the security panel is mounted to the frame and protects the glass within the frame; the method comprising the steps of: associating the wedge with the security panel via weather sealing tape; placing the security panel rear side on the frame; attaching the security panel to the frame; placing the cap onto the wedge front side; holding the cap against the wedge; and pushing a force on the cap to associate the cap with the wedge. Thus, again, an advantage may be that a protective security panel can be installed securely against a window or other glass panel and can be custom fit to any size window or glass panel. Another advantage may be that a protective security panel may be installed by mounting components on an outer surface of a window or door frame, which may be a method of installation preferred by some users, and may decrease the amount of components needed for the installation of a security panel framing system. Another advantage may be that the security panel framing system is durable and can withstand damage or attack. Another advantage may be that the appearance of the security panel framing system is seamless and can blend into existing framing, and screw heads are hidden from view to provide a more aesthetically pleasing look. Another advantage may be that bugs, dust, water, or other contaminants may be blocked from entering the system or prevented from damaging the system by the sealant and desiccant.

The above embodiment(s), aspects and advantages, as well as other embodiment(s), aspects and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
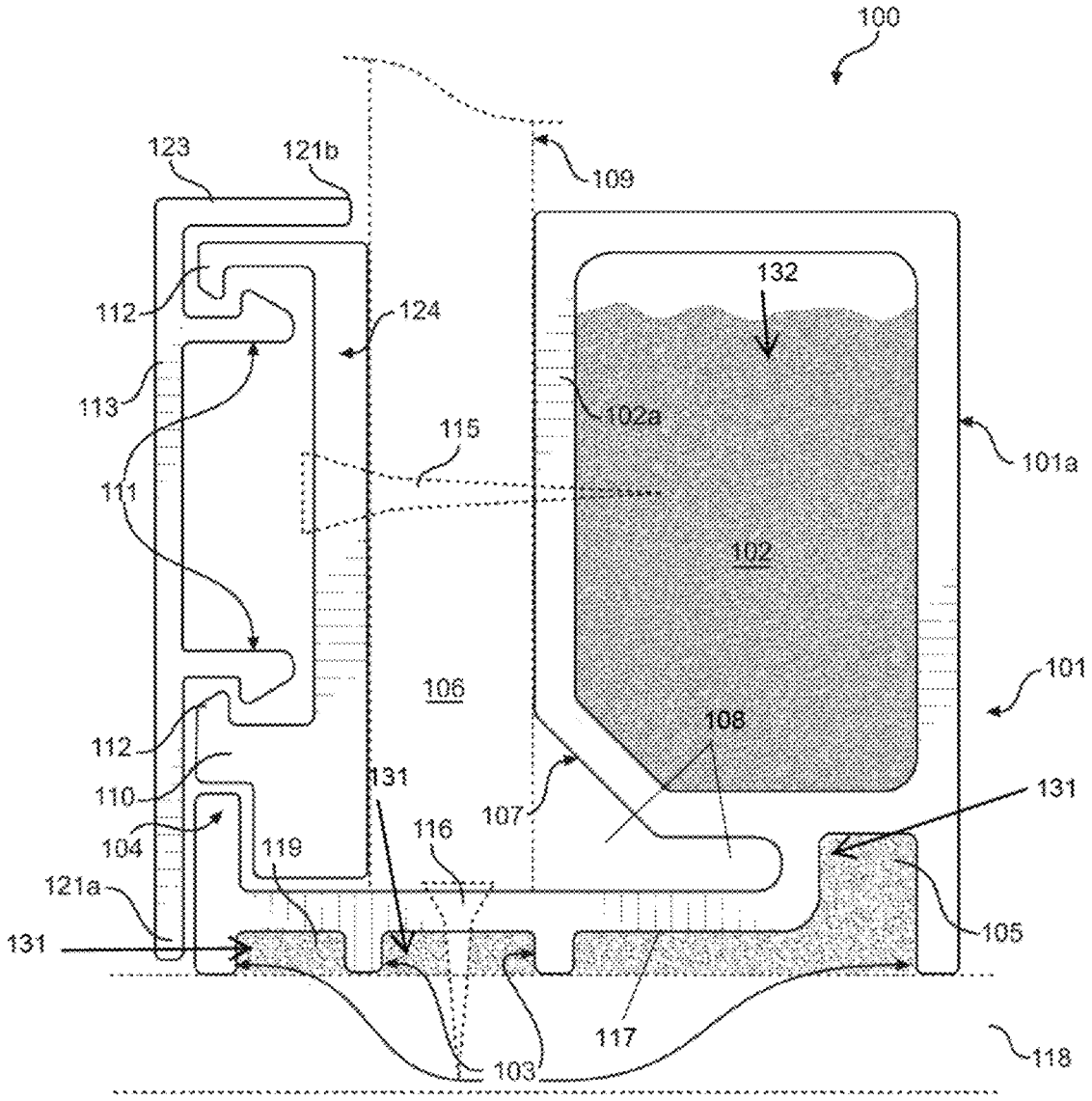
FIG. 1 illustrates a cross-sectional side elevation view of a security panel framing system, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 101 and 901, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates a cross-sectional side elevation view of a security panel framing system ('security panel framing system," "security system," or "system") 100, according to an aspect. The security panel framing system may be used for adding security or strength to a window, for example. As shown, the security panel framing system 100 may include a base 101, a wedge 110, and a cosmetic cap ("cosmetic cap," "cover," or "cap") 113, all three elements fitting together to provide a secure, unique, cosmetically viable and aesthetically pleasing appearance that may blend seamlessly with existing commercial or residential glass framing. The security panel framing system 100 can be used inside or outside of an existing glass framing to enhance its ability to provide security, as it will be described in detail hereinafter.

The security panel framing system 100 may be made from, for example, aluminum, which may, for example, be anodized or powder-coated colors to protect the aluminum from corrosion and the elements, or any other damage from the weather. Coating or any other similar treatments may also help to prevent rust; the material of the security panel framing system 100 itself may also be resistant to rust or corrosion. Further, the system 100 may be offered in various colors of anodized materials, which may be used to match existing glass framing. It should be understood that all parts or components of the security panel framing system 100 may be anodized, painted, powder coated, or otherwise colored by any other suitable means, and it should also be understood that all parts or components may thus be protected from corrosion or oxidation. It should be understood that all parts or components may also be provided in its raw aluminum milled finish, with no additional finish applied.

The base ("base" or "base element") 101 may be comprised of a base frame 101*a* and a base plate 117. The base frame may be a five-sided element 101*a* having five sides when viewed from a side elevation view as shown in FIG. 1. The five-sided element 101*a* may have a front side, a back side, a top side, and a bottom side. The bottom side may include a slanted edge or side ("slanted edge," or "slanted side") 107 such that two sides of the five-sided element are along the bottom side of the base frame, and the front side may face the wedge 110. The base plate 117 may be positioned underneath the bottom side of the base frame 101*a*. The wedge 110 may also have a front side, a back side, a top side, and a bottom side. When the security panel framing system 100 receives a security panel 109, the security panel 109 may be fitted snugly against the back side of the wedge 110 and the front side of the base frame 101*a* of the base 101.

The base element 101 may have a raised base plate 117, which may be raised using a plurality of protrusions or legs ("protrusions" or "legs") 103. The raised configuration of the base 101 and base plate 117 may allow for a sealant 131 to fill the spaces 119 created by the protrusions 103, base plate 117 and an existing glass/window frame 118, to better secure the system 100 to an existing frame 118 for a glass panel, such as a window. Additionally, the sealant 131 can help to also seal out water, bugs and dust. A screw 116 may also be used to help secure the system 100 to the existing glass frame 118, in addition to the sealant. An additional benefit of the raised configuration of the base plate 117 is that it may also prevent the screw 116 from bending or warping the base plate 117 as the screw 116 is tightened down into the existing glass frame 118, by providing a space for the pieces of the system 100 to expand or move during the installation process. Further, the height of the protrusions 103 can control how much seal/glue will be left between the base plate 117 and the existing glass/window frame 118, thus controlling the strength of the bond between the two elements. Moreover, it should be noted that at least one recess ("recess" or "larger space") 105 may be provided that is larger than the rest of the spaces 119, to reduce the material (e.g., aluminum) needed for the construction of the base element 101, while still increasing the strength of the base. This configuration may also prevent water from infiltrating into the cavity or inner hollow channel ("inner hollow channel," "hollow channel," or "inner channel") 102 of the base 101, which may hold or house a desiccant 132 in case of humidity, heavy rain or other unusually heavy water event such as a flood. Also, the slanted side 107 of the base 101 and the spaces may help to drain out water should the system be flooded in heavy sheeting rain or a flood, for example. This design may also give maximum strength to the system 100 while also reducing the amount of aluminum that would be needed for the construction of an alternative embodiment where these areas are solid aluminum throughout. Since the cost of the system may largely be based on the weight of aluminum used, the structural configurations shown as examples herein may be efficient by providing maximum strength with the least amount of aluminum possible.

It should be understood that a plurality of screws 115 and 116 may be used as necessary. For example, screws can be placed every 6 (six) inches along the entire length (shown by 220 in FIG. 2A) of the base 101 and along the base plate 117. Their use in addition to the sealant may be preferred because it may result in an enhanced bond between the base plate 117 and the existing glass frame 118, and between a channel wall 102*a* and the panel 109, thereby making the system less likely to fail during a forceful entry attempt by, for example, a burglar or active shooter.

The base 101 may have an inner hollow channel 102, which can receive and be completely or partially filled a desiccant 132 to absorb moisture between the existing window glass 118 and the security panel 109. The moisture may be absorbed and allowed in via holes (not shown), which can be drilled at the installation site, for example. The holes may be drilled on the bottom framing component only and spaced for example every 12" to 18" (one hole every 12-18"). The amount of desiccant used may depend on the size of the window, the size of the gap between the existing glass and the security panel and the climate zone where the building is located. Again, as described above, the base 101 may also be constructed to have a space or spaces 108 for minimizing the amount of aluminum or other material needed for the construction of the base 101. The space or spaces 108 may also be helpful for drainage, to allow water to drain away from the desiccant cavity. Silica beads or any other suitable desiccant may be used, for example, and any suitable desiccant 132 may be placed into the hollow inner channel 102 by, for example, a funnel, or any other suitable means.

To install the security panel framing system 100, first, the three parts (i.e., base 101, wedge 110 and cap/cover 113) may be taped or otherwise associated together and cut so that their length (shown by 220 in FIG. 2A) matches the specific window dimensions (e.g., left and right height and top and bottom width in the case of a rectangular window) of the window to be protected, so as to make sure they are all cut exactly the same length since they will be assembled to form one system. The system may thus be custom made or custom fitted to any size window or glass panel. It should be understood that, as an example, certain components, such as the base 101 and the legs 103 of the base may be provided separately, such that a user may custom fit the security panel framing system to their needs. As another example, a complete base 101 may be provided, and may be provided in a variety of sizes such that a user may choose the correctly sized base 101 for their needs.

Next, a sealant may be added to existing window frame 118 and/or the base plate 117 (on the protrusions side) and a desiccant may be added to the hollow channel 102 of the bottom frame only, preferably. Holes may be drilled every 12"-18" to allow for moisture to access the desiccant. A rubber grommet may be added to each hole, which may be used for a cosmetic finish. Next, the base 101 may be screwed down using screw(s) 116 to the existing window frame 118. Again, the combined bonding effect of the sealant (which preferably seals and bonds) together with the screw(s) 116 may result in a stronger link between the security panel framing system 100 and the existing window frame 118.

Next, once the base 101 has been installed on all sides, such as on all corners of the frame, and thus a security frame is formed, a panel 109 may then be cut to size, added to the security frame and held in place by the installer or user until the wedge 110, and screws 115 can be added into a wall 124 of the wedge. The wedge may have holes pre-drilled in the center section along its entire length, usually every 6"-8", and one such hole may occur where the screw 115 is shown as an example in FIG. 1. The holes may be sized to be just barely large enough for the screws 115 to travel through with no resistance, yet small enough to prevent the screw head from passing through, thus allowing the screw 115 to be tightened securely. Next the wedge 110 may be held into position against the security panel 109 and screws 115 may be driven through the pre-drilled holes, traveling through both the wedge 115 and the security panel 109 (e.g., through pre-drilled holes) and then into the base 101, approximately into the center of the innermost desiccant channel wall 102*a*, thus securing the security panel 109 to the base and thus to the existing window frame 118. Optionally, for increased strength and a better seal, a sealant can also be used in addition to the screws 115, between the base 101 and the security panel 109 and/or between the security panel 109 and the wedge 110. A final bead of clear silicone may be used around the perimeter once the cap is installed. This clear bead may be very thin and virtually invisible, yet may prevent water from getting under the cap 113 in around the wedge. This clear silicone bead may be installed approximately in front of the protrusion 103 that is closest to the cap 113, such as at the location indicated by 121*a* as an example. Additionally, another similar small thin bead of clear silicone may be used at the top of the cap 113 where it meets the security panel 109 for the same purpose, at the location indicated by 121*b* as an example. It should be understood that there may be slight gaps intentionally left in these two locations 121*a* and 121*b* to allow the clear silicone to properly seal in those areas to create a waterproof seal.

As shown in FIG. 1, the base plate 117 may have a lip or stopper ("base plate lip," "base plate stopper," or "stopper") 104 that blocks a reinforced (e.g., thicker, as shown) portion 114 of the wedge 110, thus preventing the wedge 110 from twisting or pulling away under pressure of an attack. This is important as the security panel 109 may incur significant "peel" and outward pressure when attacked, and this and any warping as a result of a force applied to the panel may be alleviated or lessened by the presence of the lip 104.

It can be noted in FIG. 1 that the configuration of the security panel framing system 100 may allow the outer edges of the security panel 109 to be encased snugly into the space 106 created by the base 101 and wedge 110. The security panel 109 may be constructed from any suitable material (e.g., polycarbonate, acrylic or similar or a combination of materials) for the security purpose sought (e.g., to prevent break in, bulletproof, etc.). Further examples of materials for the security panel 109 may include thermoplastic, laminated glass, or other types of plastics. Such materials may be containment-grade, and may have ballistic or non-ballistic ratings.

After following the steps described hereinbefore, the base 101, the security panel 109 and the wedge 110 may all be solidly attached to the window frame 118, creating a shield that prevents a criminal from gaining access to a building. In the case of a ballistic panel being added, bullets may be prevented from passing through.

Next, a water-resistant sealant may be applied around the edge of the framing and security panel and tooled to a cosmetic finish.

Lastly, a cap or cover 113 may be snapped into place (as shown in FIG. 1). The cap or cover 113 may be particularly designed to snap in place over the security system 100. The cap 113 may form a covering for the screw heads 115 to give a final, finished cosmetic look to the security panel framing system 100, and may contribute to a clean or aesthetically desirable look to the system 100. As seen in FIG. 1, as an example, the cap 113 may be provided with three portions or protrusions that extend outwards: a top arm 123, and two prongs 111, which may be an upper prong and a lower prong. The upper and lower prongs 111 may be able to snap and lock into corresponding wedge lips 112 when the installer or user applies outside pressure to the cap 113. This can hold the cap 113 tightly and securely into place.

Figure 2A:
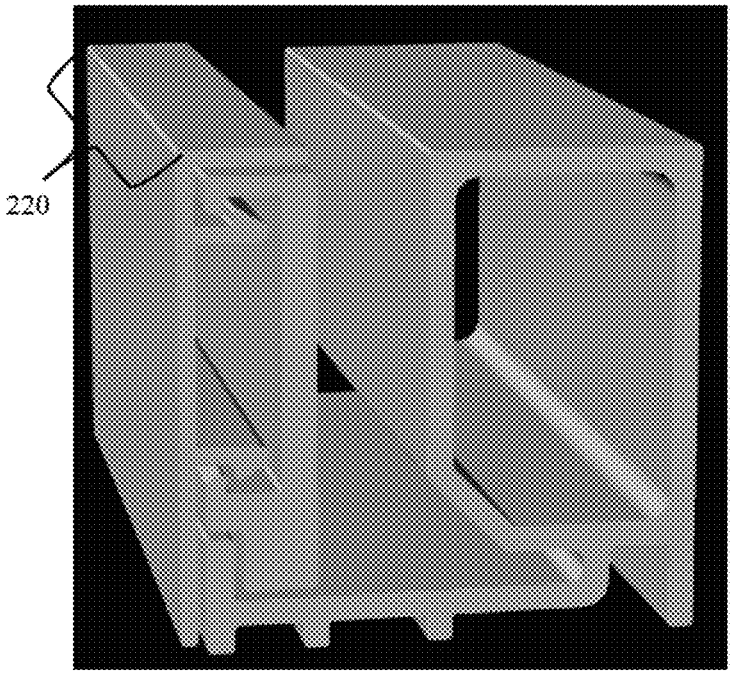
FIGS. 2A-2C illustrate various perspective views of the security panel framing system from FIG. 1, according to an aspect.
Figure 2B:
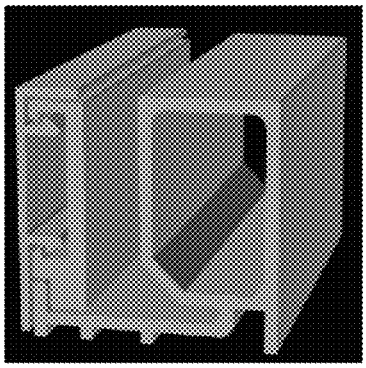
Figure 2C:
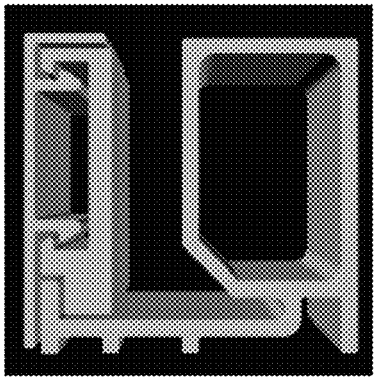

FIGS. 2A-2C illustrate various perspective views of the security panel framing system from FIG. 1, according to an aspect.

Figure 2D:
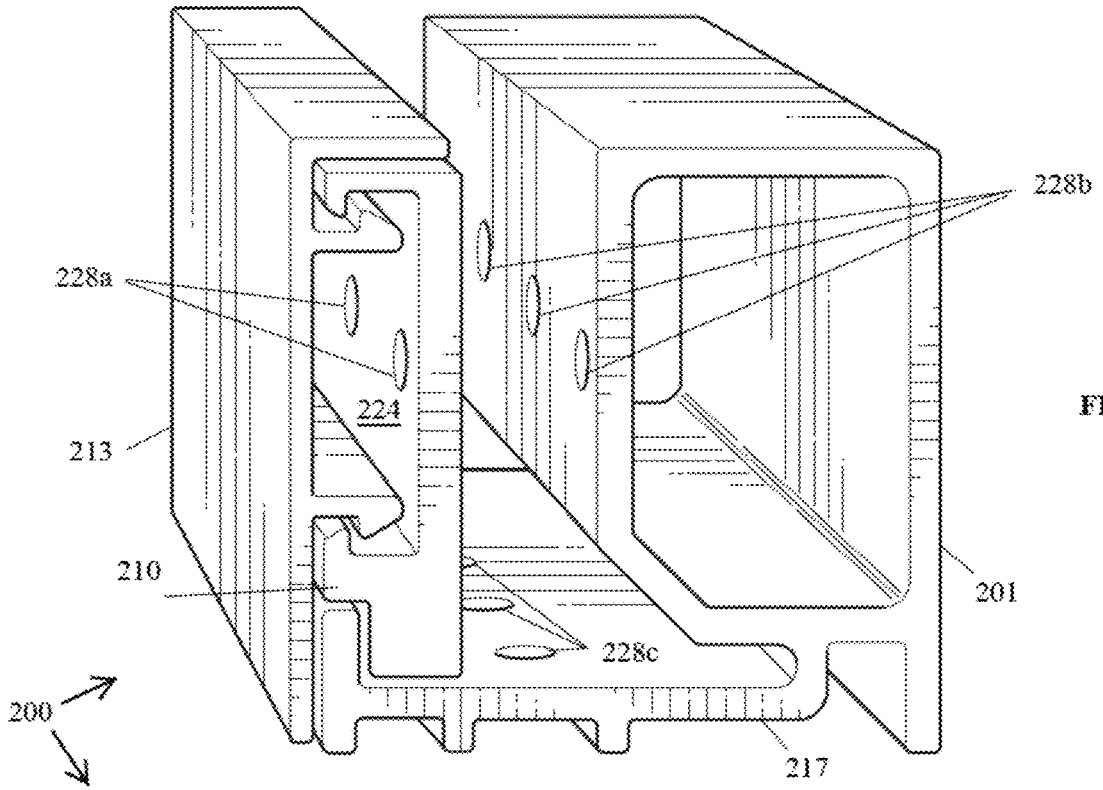
FIGS. 2D-2E illustrate perspective views of the security panel framing system shown with provided screw holes, and shown with screws installed into the provided screw holes, respectively, according to an aspect.
Figure 2E:
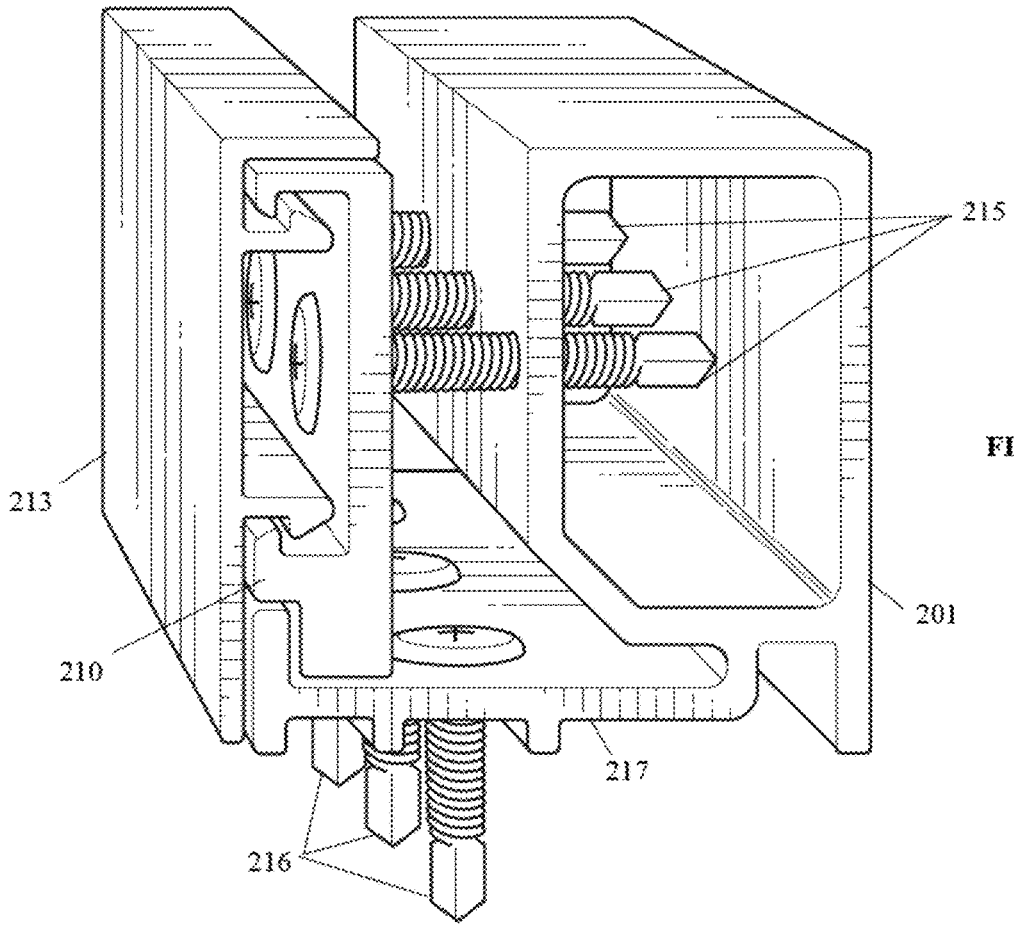

FIGS. 2D-2E illustrate perspective views of the security panel framing system 200 of FIGS. 1-2C, shown with provided screw holes 228*a*, 228*b*, and 228*c*, and shown with screws 215 and 216 installed into the provided screw holes 228*a*, 228*b*, and 228*c*, respectively, according to an aspect. As was previously discussed when referring to FIG. 1, a screw or a plurality of screws 215 and 216 may be used for further securement of the security panel framing system 200 onto an existing window frame. Screws 215 and 216 may, for example, be self-tapping screws, which may be directly drilled or screwed into the various components of the security panel framing system 200. Several screw holes may be provided in the security panel framing system 200. A set of screw holes 228*a* may be provided in the wedge wall 224 of the wedge 210, and another set of screw holes 228*b* may be provided in the base 201, and another set of screw holes 228*c* may be provided in the base plate 217. The cap 213 may obscure or cover the screws once installed, as shown in FIG. 2E.

Figure 2F:
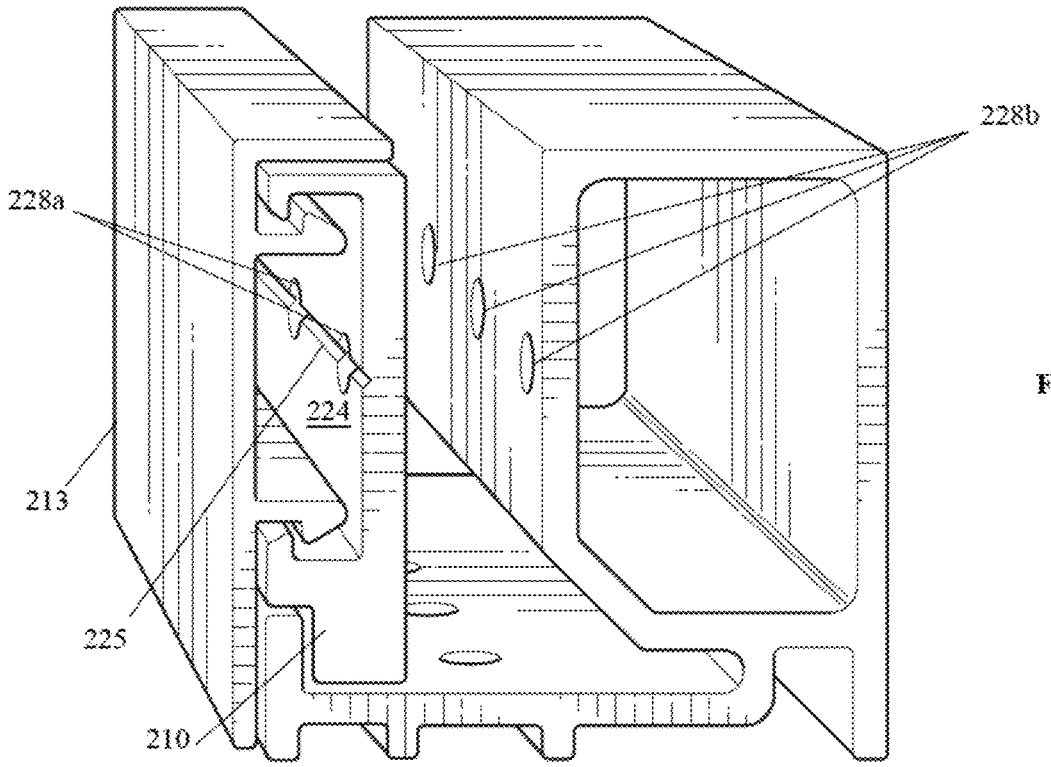
FIGS. 2F-2G illustrate perspective views of the security panel framing system, shown with provided screw holes, and shown with screws installed into the provided screw holes, respectively, wherein a groove is provided in the wedge wall, according to an aspect.
Figure 2G:
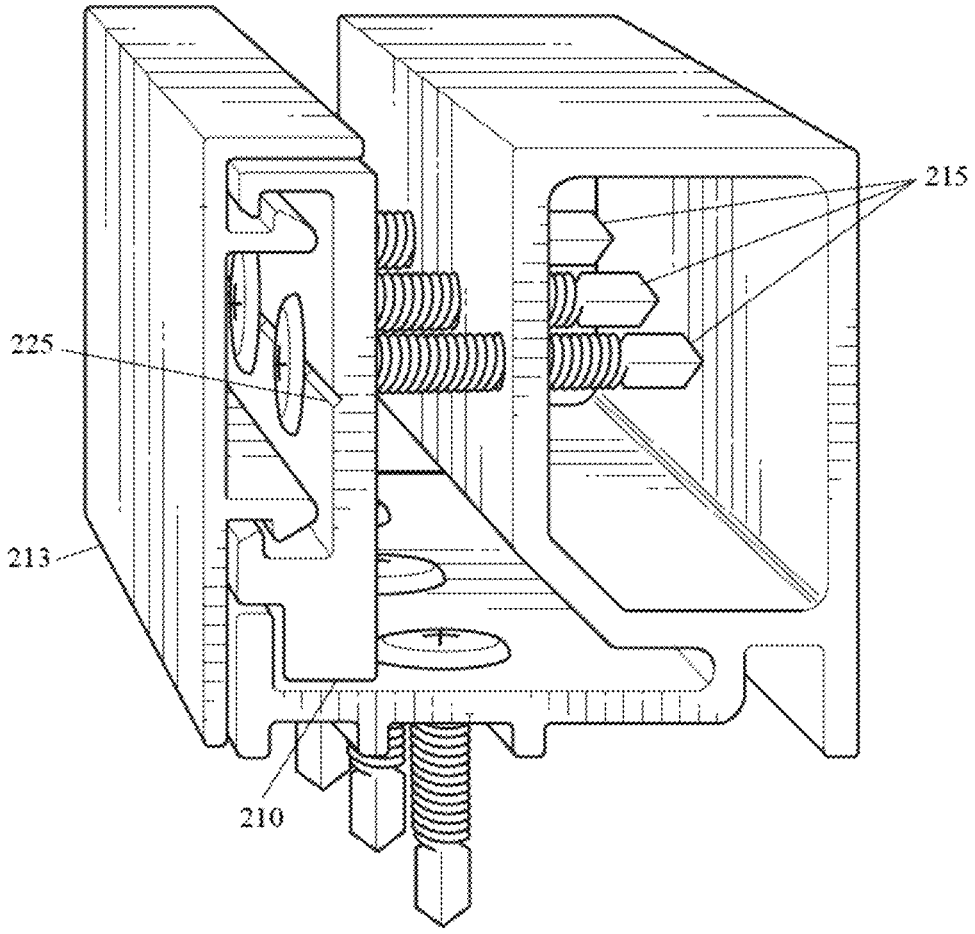

FIGS. 2F-2G illustrate perspective views of the security panel framing system 200 of FIGS. 1-2C, shown with provided screw holes 228*a*, 228*b*, and 228*c*, and shown with screws 215 and 216 installed into the provided screw holes 228*a*, 228*b*, and 228*c*, respectively, wherein a groove 225 is provided in the wedge wall 224, according to an aspect. The groove 225 is discussed further herein when referring to FIG. 8B. Screws 215 may pass through a security panel placed in the space presented by 206, which is shown and described in further detail when referring to FIG. 1.

It should be understood that a security panel framing system 200 may be provided with screws such as screws 215 and 216 only, or with screws 215 and 216 together with screw holes. It should also be understood that, when self-tapping screws are used, screw holes may be created by the action of the user screwing in or drilling the screws into the system. The security panel framing system 200 may thus be provided with no screw holes, or only having screw holes 228*a*, wherein the screw holes 228*b* and the screw holes 228*c* are created by the user drilling or screwing in the self-tapping screws 215 and 216, for example.

Thus, if screw holes are provided in the system, a screw or a plurality of screws 215 may be installed first through the plurality of screw holes 228*a* and next through the screw holes 228*b*. Another plurality of screws 216 may be installed through screw holes 228*c*.

Figure 3:
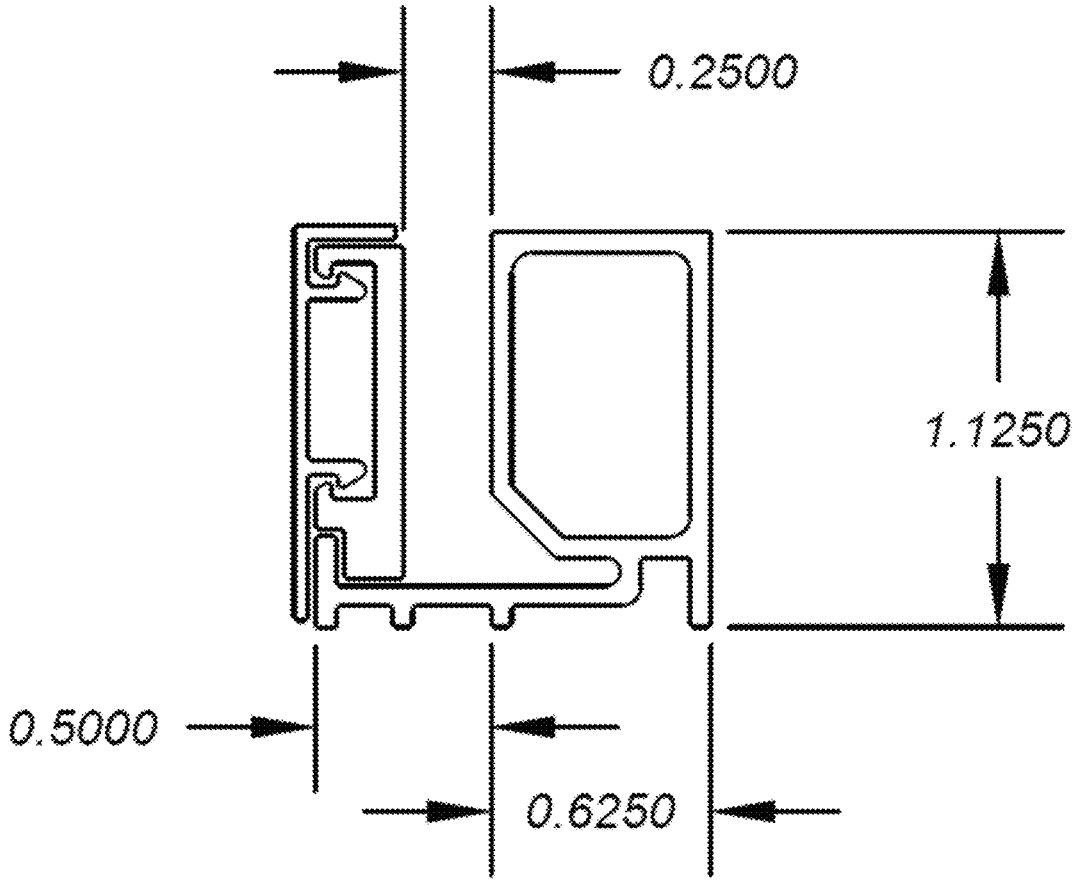
FIG. 3 shows exemplary dimensions for some portions of the security panel framing system from FIG. 1, according to an aspect.

FIG. 3 shows exemplary dimensions in inches for some portions of the security panel framing system from FIG. 1, according to an aspect.

Figure 4:
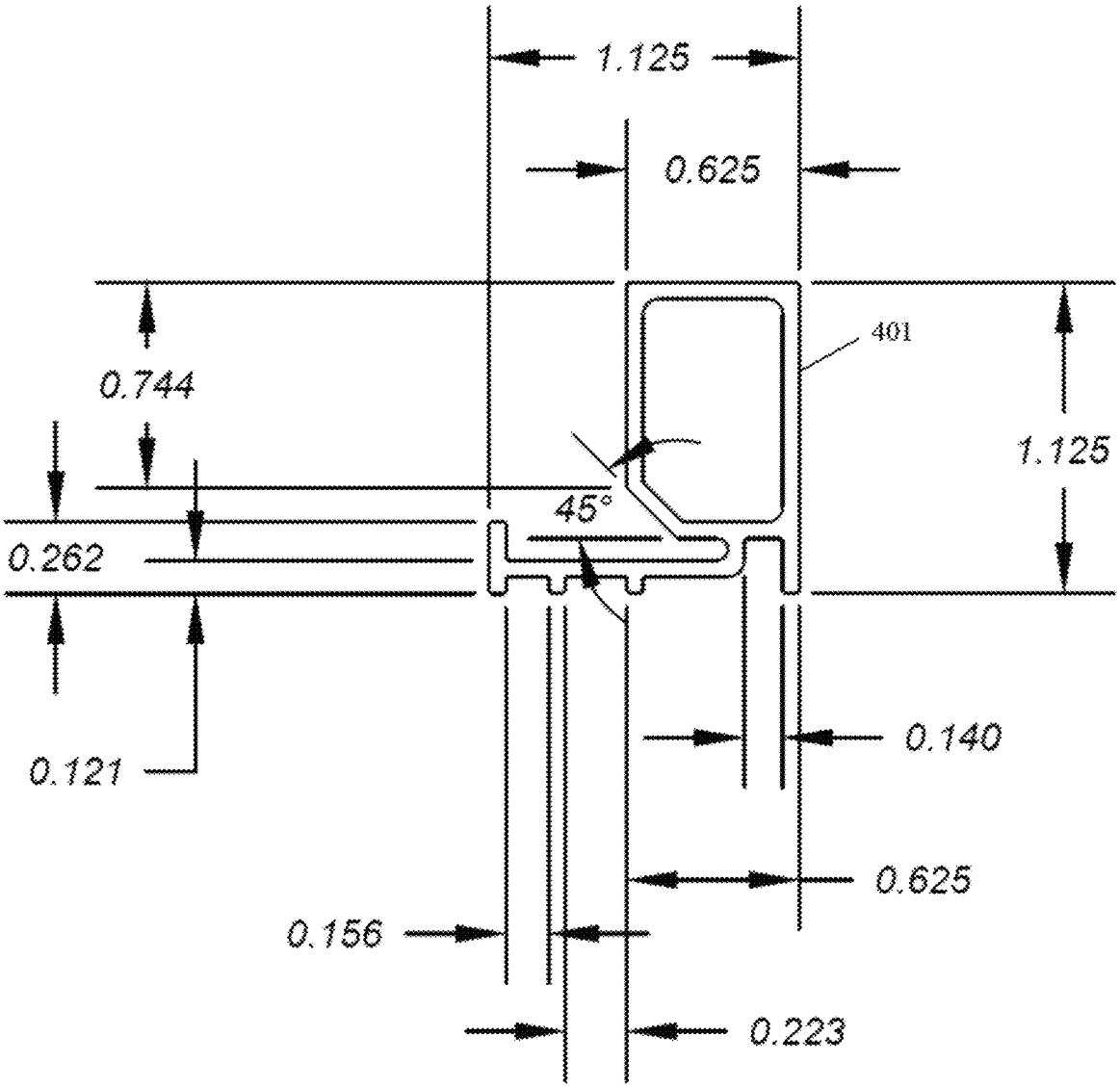
FIG. 4 illustrates the cross-sectional view of the base element of the security panel framing system and some exemplary dimensions of the base element, according to an aspect.

FIG. 4 illustrates the cross-sectional view of the base element 401 of the security panel framing system and some exemplary dimensions in inches of the base element, according to an aspect. Also shown as an example is an exemplary angle that the base 401 may be constructed with.

Figure 5:
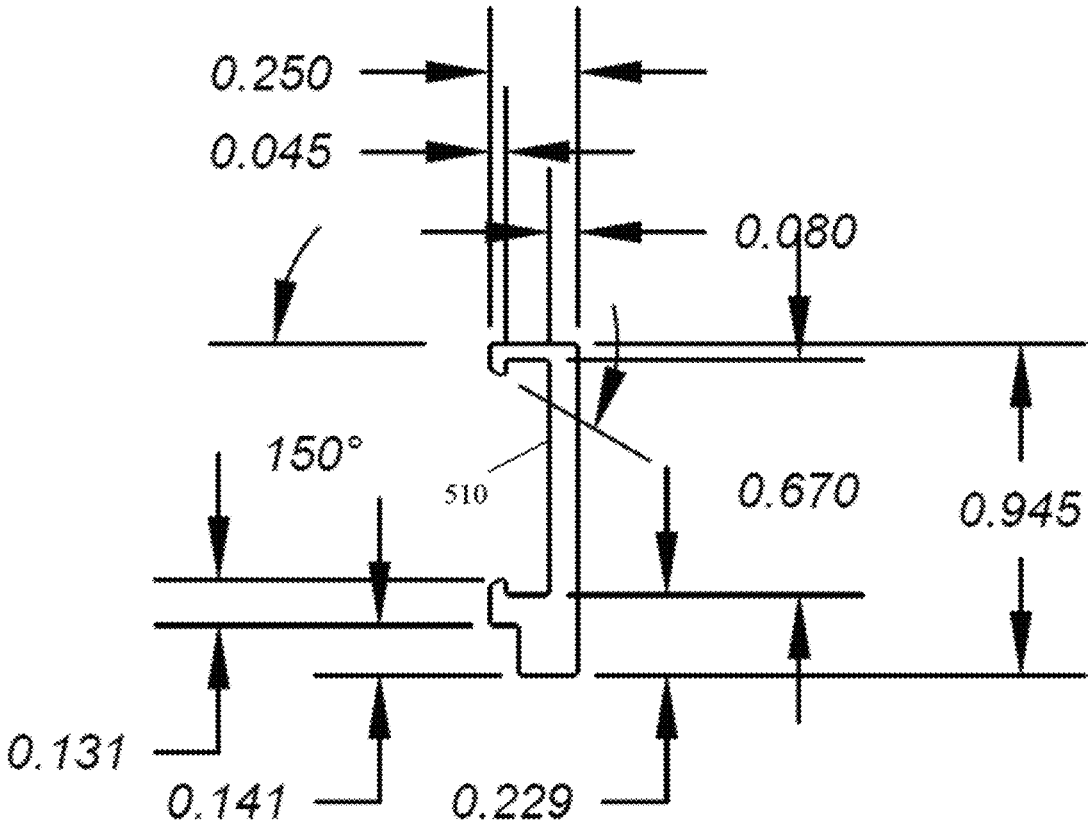
FIG. 5 illustrates the cross-sectional view of the wedge element of the security glass framing system and some exemplary dimensions of the wedge element, according to an aspect.

FIG. 5 illustrates the cross-sectional view of the wedge element 510 of the security glass framing system and some exemplary dimensions in inches of the wedge element 510, according to an aspect. Also shown as an example is an exemplary angle that the wedge 510 may be constructed with.

Figure 6:
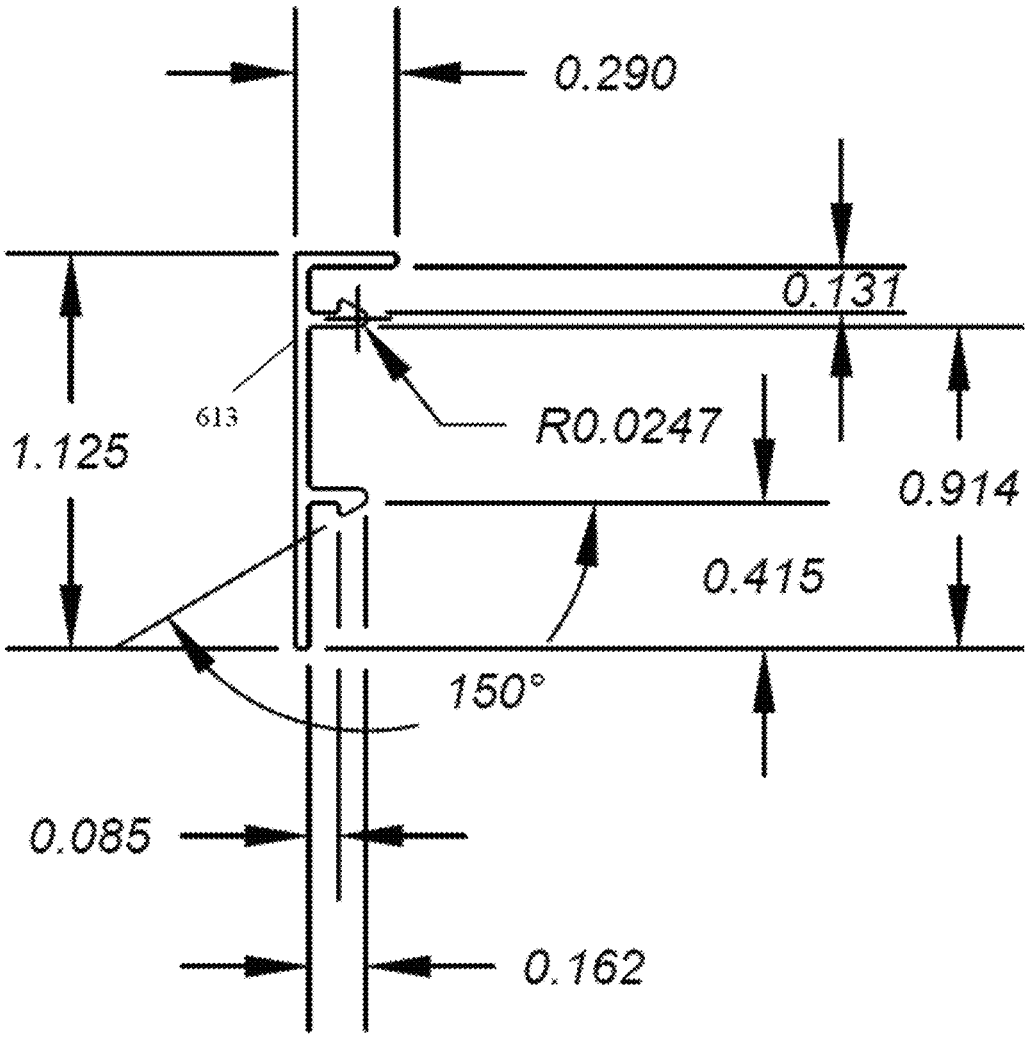
FIG. 6 illustrates the cross-sectional view of the cap element of the security panel framing system and some exemplary dimensions of the cap element, according to an aspect.
Figure 7A:
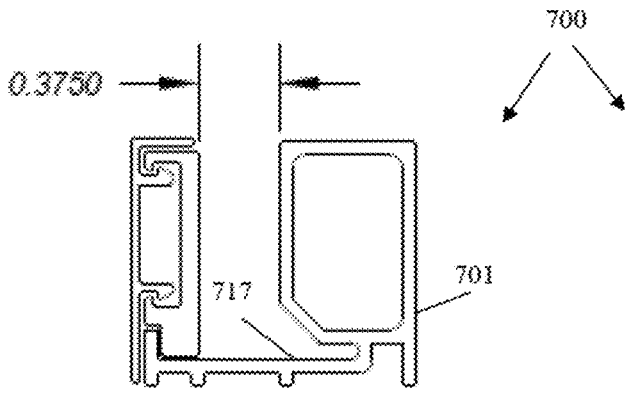
FIGS. 7A-7D illustrate four exemplary alternative embodiments of the security panel framing system, according to an aspect.
Figure 7B:
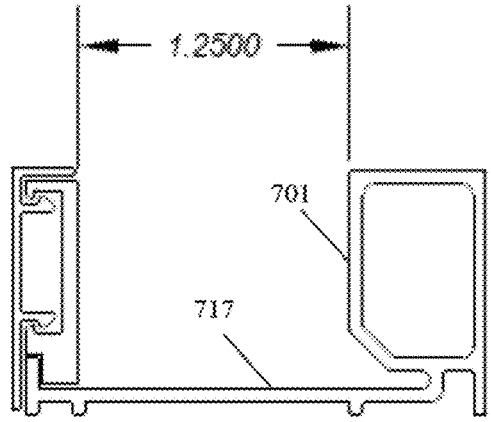
Figure 7C:
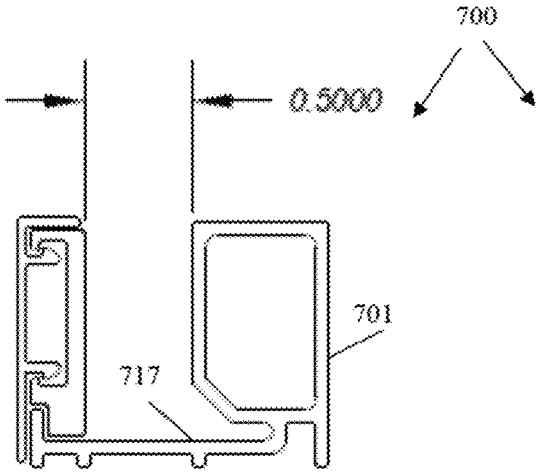
Figure 7D:
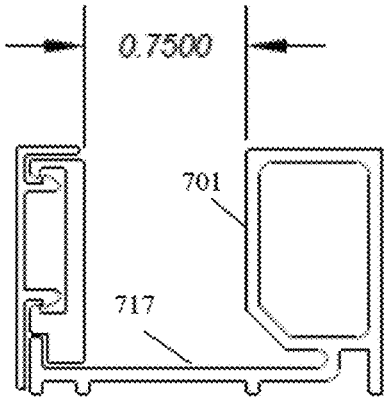

FIG. 6 illustrates the cross-sectional view of the cap element 613 of the security panel framing system and some exemplary dimensions in inches of the cap element 613, according to an aspect. Also shown as an example is an exemplary angle that the cap 613 may be constructed with.

FIGS. 7A-7D illustrate four exemplary alternative embodiments of the security panel framing system 700, according to an aspect. The security panel framing system 700 may be adapted to receive security panels having different thicknesses, such as the exemplary thicknesses shown, in inches. Alternative embodiments of the system may include a base 701 having a longer base plate 717 than the example shown in FIG. 1 in order to accommodate a thicker security panel. Alternatively, a base plate 717 may be shorter than the example shown in FIG. 1 if a thinner security panel is to be used in the security panel framing system 700.

Figure 8A:
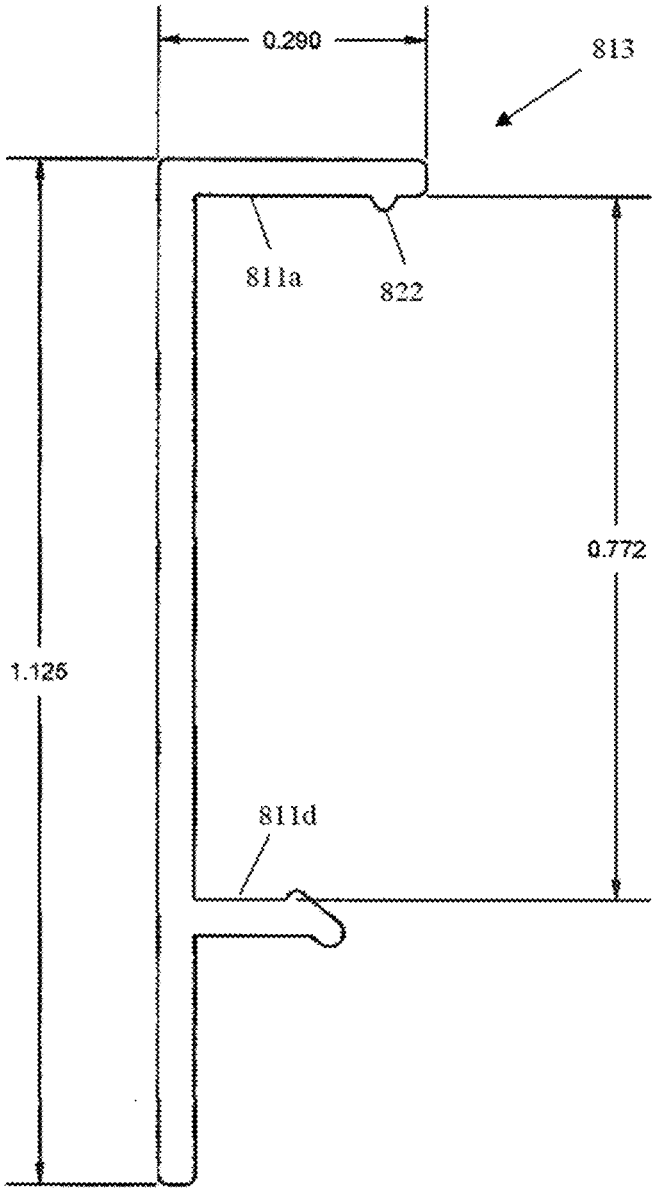
FIGS. 8A-8C illustrate the side view of another example of the cap, the side view of another example of the wedge, and an assembled side view of the cap with the wedge, respectively, according to an aspect.
Figure 8B:
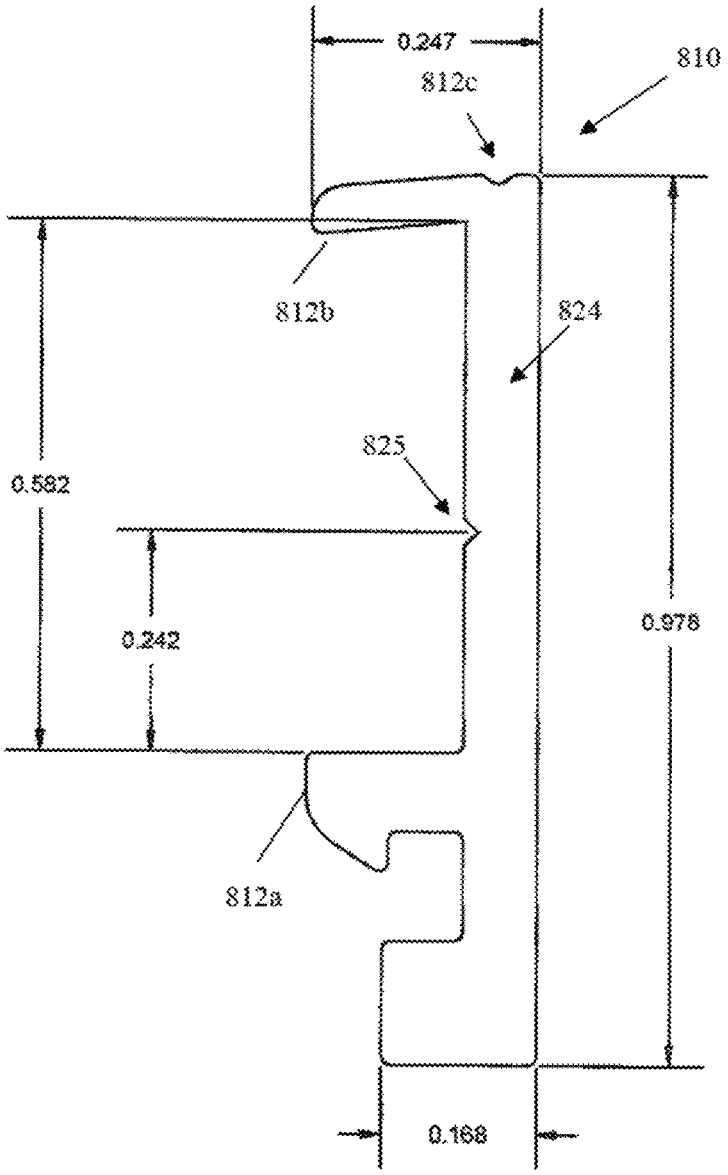
Figure 8C:
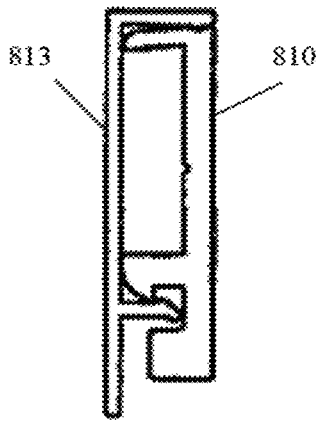

FIGS. 8A-8C illustrate the side view of another example of the cap 813, the side view of another example of the wedge 810, and an assembled side view of the cap 813 with the wedge 810, respectively, according to an aspect. FIGS. 8A-8B also show some exemplary dimensions in inches of the various components shown. Similar to the example of the cap 113 shown in FIG. 1, the cap 813 as shown in FIG. 8A may alternatively be provided with two portions or protrusions that extend outwards: an upper prong 811*a* and a lower prong 811*d*. The upper prong 811*a* may be provided with a bead 822. An advantage of two protrusions as opposed to the three as shown in FIG. 1 may be that less materials may be needed to construct the cap 813. The cap 813 may thus weigh less, and may be more cost efficient to produce.

The cap 813 as shown in FIG. 8A may be paired with or snap into a correspondingly shaped wedge 810 as shown in FIG. 8B. As an example of a corresponding wedge, the wedge may be provided with an alternative embodiment of a lower wedge lip 812*a*, and a top wedge lip 812*b* having a notch 812*c*. The notch 812*c* may be located on a top side of the top wedge lip 812*b*, such that it can receive the bead 822, and the lower wedge lip 812*a* may be shaped to correspond with the lower prong 811*d* of the cap 813.

The wedge 810 may be provided with pre-drilled holes (not shown) in the wall 824 of the wedge, which may be used for installing screws, such as the example shown by 115 in FIG. 1. Again, the wedge 810 may have holes pre-drilled in the center section or midsection of the wall 824 along its entire length, usually every 6"-8", and one such hole may occur where screw 115 is shown as an example in FIG. 1. Again, as discussed in paragraph 0031, each component of the security panel framing system may be provided in larger pieces which may then be cut down to size by a user according to their needs, such that any size window or glass panel may be protected by the system. When cutting down the wedge piece, a user may need to drill additional holes into the wedge if the cutting of the wedge removed too many holes, or if the wedge was not provided with pre-drilled holes. The wedge wall 824 may also be provided with an indent or groove which may be V-shaped ("V-groove," "groove," or "indent") 825 along the length of the wall (as represented by 220 in FIG. 2A). The groove may serve as a guide for a user who needs to drill additional holes for screws, for example, or as a guide for the placement of a screw to be directly drilled in through the wedge. The groove may help a drill to be placed at the correct position for the holes. The groove 825 may be provided along the entire length of the wedge such that when the wedge is cut to a suitable size, the guide for the drill is present even after the wedge is cut.

As shown in FIG. 8C, the wedge 810 and the cap 813 may be associated together. As discussed when referring to FIG. 1, a force may be applied by the user to the cap 813 in order to snap the cap 813 onto the edge 813.

Figure 9A:
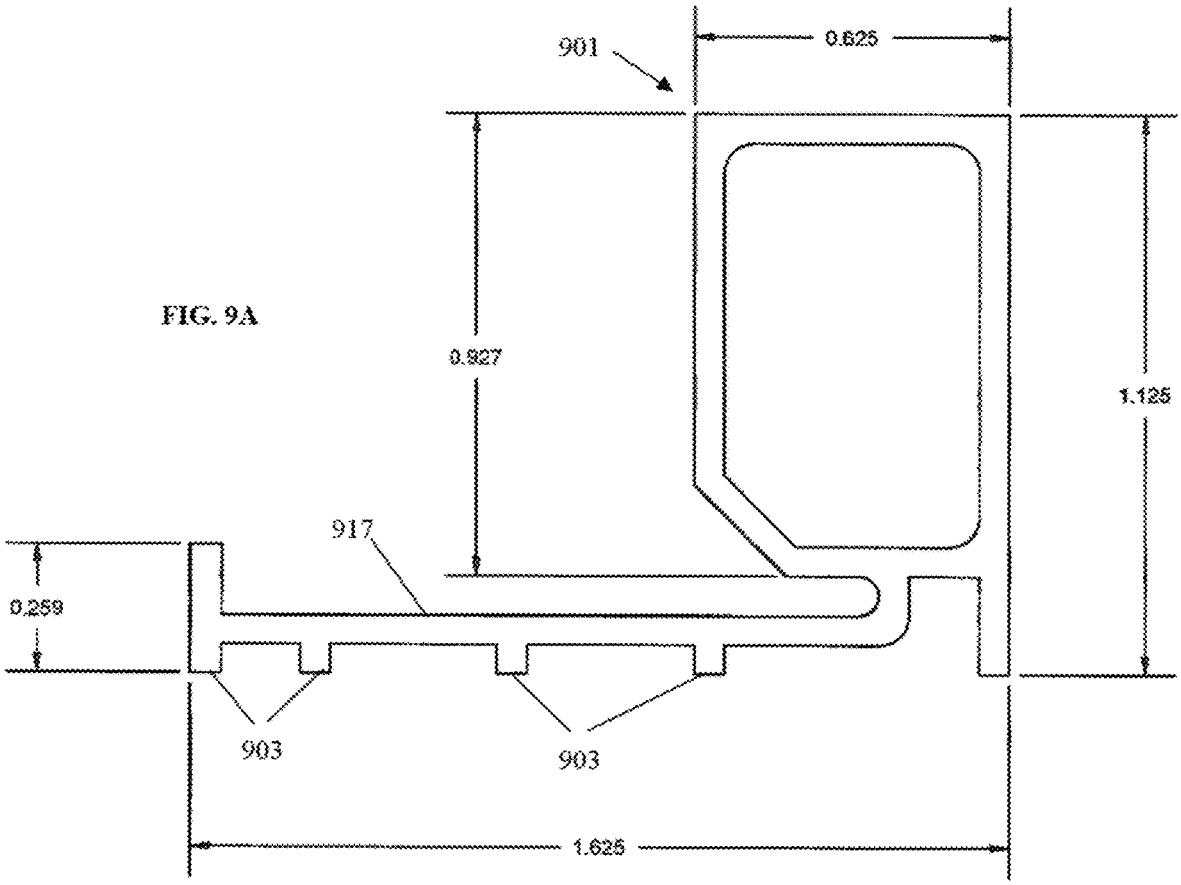
FIG. 9A illustrates the side view of another example of a base element, according to an aspect.

FIG. 9A illustrates the side view of another example of a base element 901, according to an aspect. Again, a base element 901 may be provided with a longer base plate 917 than the example shown in FIG. 1 in order to accommodate a thicker security panel, for example. A longer base plate 917 may include additional protrusions or legs 903. As an example, the base element 901 may be provided with four protrusions 903. The longer that a base plate 917 is, the more balance may be needed, and additional protrusions 903 may help to stabilize the base plate 917.

Figure 9B:
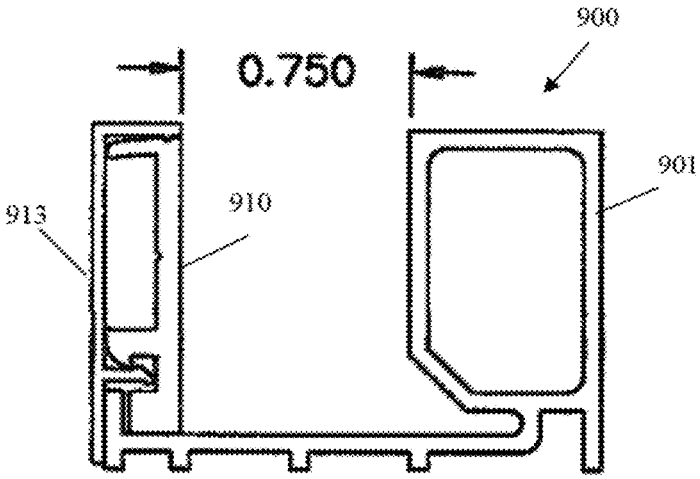
FIG. 9B illustrates the side view of an assembled security panel framing system using the base element of FIG. 9A, and the wedge and cap configuration of FIG. 8C, according to an aspect.

FIG. 9B illustrates the side view of an assembled security panel framing system 900 using the base element 901 of FIG. 9A, and the wedge 910 and cap 913 configuration of FIG. 8C, according to an aspect. FIGS. 9A-9B also show some exemplary dimensions in inches of the various components shown.

Figure 10A:
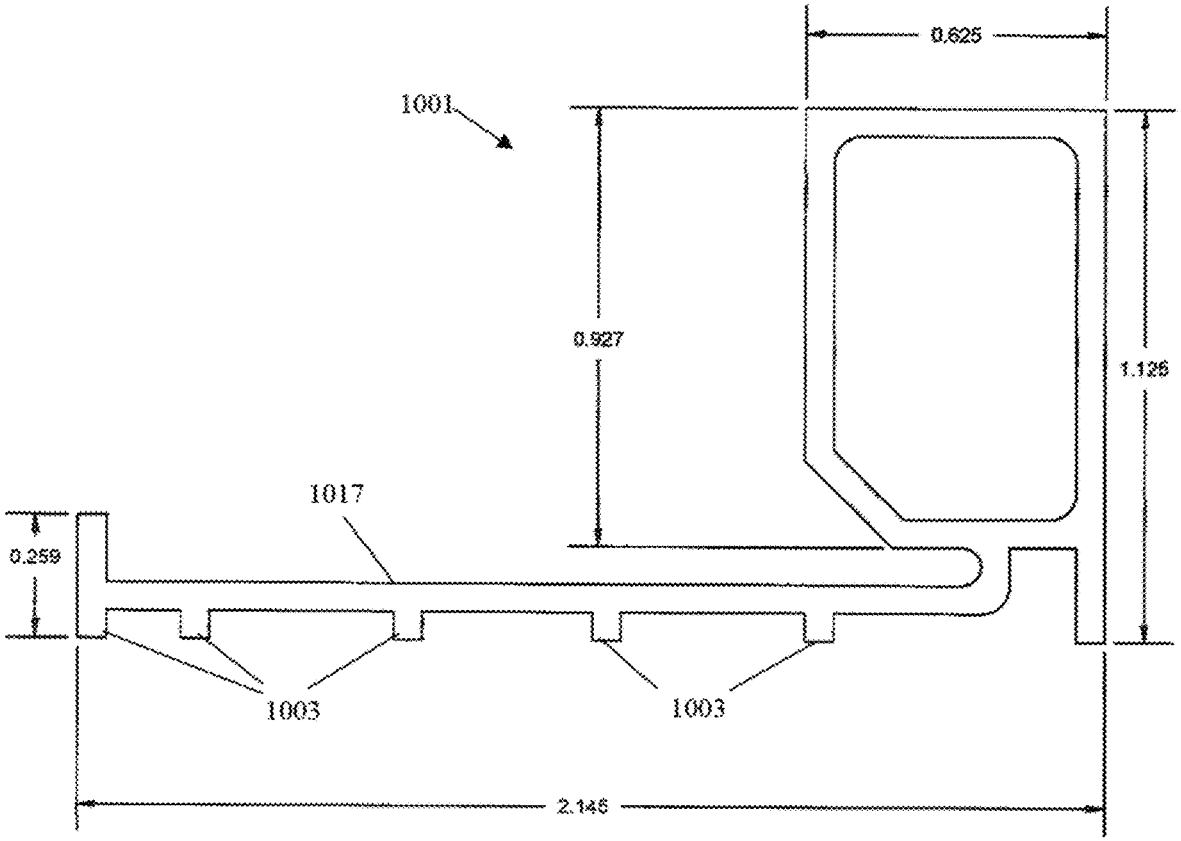
FIG. 10A illustrates the side view of another example of a base element, according to an aspect.

FIG. 10A illustrates the side view of another example of a base element 1001, according to an aspect. A base element 1001 may be provided with a longer base plate 1017 than the example shown in FIG. 9A in order to accommodate a thicker security panel, for example, and may be provided with, for example, five protrusions. It should be understood that any suitable number of protrusions may be provided for the base plate 1017 in order to provide a sufficient amount of stability to the system.

Figure 10B:
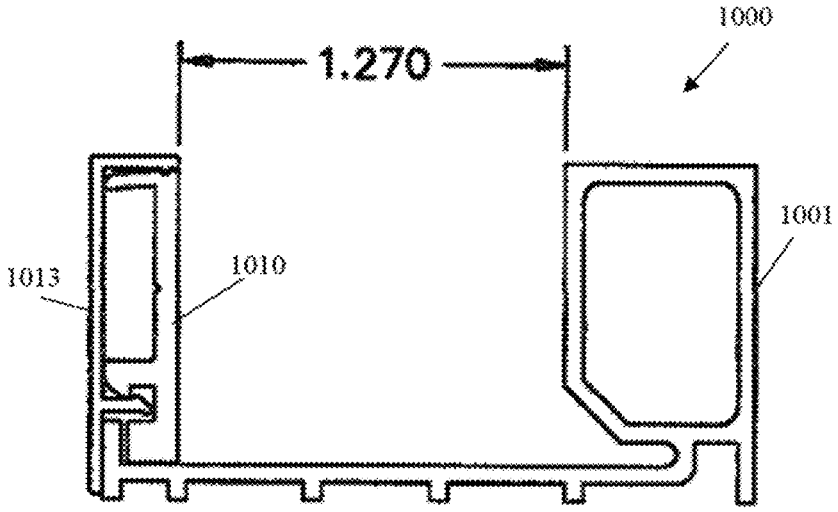
FIG. 10B illustrates the side view of an assembled security panel framing system using the base element of FIG. 10A, and the wedge and cap configuration of FIG. 8C, according to an aspect.

FIG. 10B illustrates the side view of an assembled security panel framing system 1000 using the base element 1001 of FIG. 10A, and the wedge 1010 and cap 1013 configuration of FIG. 8C, according to an aspect. FIGS. 10A-10B also show some exemplary dimensions in inches of the various components shown.

It should be understood that dimensions other than those shown in FIGS. 3-10B may be used to suit a particular application of the security panel framing system. For example, the security glass framing system may be fabricated and offered in various sizes to accommodate various thicknesses of the security panel used, which may include ¼" (inch) thickness as shown in FIG. 3, ¼", ⅜", ½", ¾", 1" and 1¼". Again, FIGS. 7A-7D, and FIGS. 8A, 8B, and 9A-10B also show additional examples of dimensions that the security panel framing system may be constructed in. It should also be understood that any suitable snap-together or locking system may be used for association of the cap element to the wedge element.

Figure 11A:
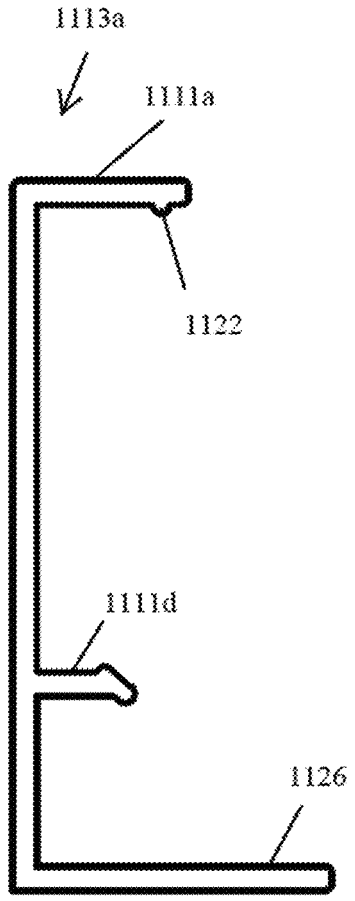
FIGS. 11A-11B illustrate the side view of another example of a cap, which may be used for surface mounting of a security panel system, and an assembled side view of the surface mount cap with a wedge, respectively, according to an aspect.
Figure 11B:
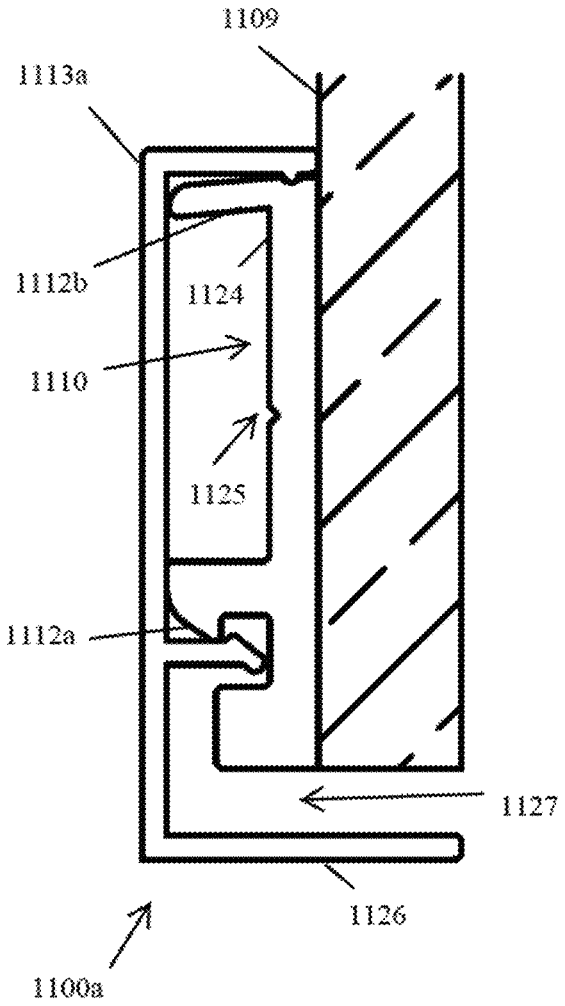

FIGS. 11A-11B illustrate the side view of another example of a cap, which may be used for surface mounting of a security panel system ("surface mount cap") 1113*a*, and an assembled side view of the surface mount cap 1113*a* with a wedge 1110 for use in another example of a security panel framing system 1100*a*, respectively, according to an aspect. A cap 1113*a* may be provided to allow a user to mount a security panel framing system to an outer surface of a door or window, for example, which may be done in cases where the existing frame of a door or window to be protected is not deep enough to accommodate the security panel framing system shown and described when referring to FIGS. 1-10B, for example. Some users may prefer to install a security panel framing system inside of the window frame, as previously described, while other users may prefer the option of mounting the security panel framing system to an outer surface of the window or door to be protected. Thus, a surface-mounting or flush-mounting system ("surface mount security panel framing system," or "surface mounted security panel framing system") 1100*a* and method of installing a security panel framing system may be used, wherein the security panel is mounted to be flush against the outer surface of the pane, window, or door to be protected.

The surface-mounting system may use a wedge 1110 as previously described, and may use a surface mount cap 1113*a* which may be similar to the cap shown and described when referring to FIGS. 8A and 10B, for example, with the addition of a return flange 1126. Again, as was previously discussed when referring to FIG. 8A, the surface mount cap 1113*a* may be provided with portions or protrusions that extend outwards: an upper prong (or "first prong") 1111*a*, and a lower prong (or "second prong") 1111*d*. Situated further below the lower prong 1111*d* may be a return flange 1126 which may extend out further than both the upper prong 1111*a* and the lower prong 1111*d* by being longer in length than both of the prongs. The upper prong 1111*a* may be provided with a bead 1122, which may be configured to be used for pairing the surface mount cap 1113*a* with a wedge 1110, for example. The wedge 1110 may be similar to the wedge shown by 810 in FIG. 8B, for example, and may be paired with or snap with the surface mount cap

1113*a*. Again, the wedge 1110 may be provided with a lower wedge lip 1112*a*, and a top wedge lip 1112*b* having a notch (shown in detail by 812*c* in FIG. 8B). The notch (shown by 812*c* in FIG. 8B) may be located on a top side of the top wedge lip 1112*b*, such that it can receive the bead 1122, and the lower wedge lip 1112*a* may be shaped to correspond with the lower prong 1111*d* of the surface mount cap 1113*a*. The height of the wedge 1110 may be shorter than the height of the surface mount cap 1113*a*, such that the surface mount cap 1113*a* extends further downwards when the surface mount cap 1113*a* and the wedge 1110 are associated together, and such that the return flange 1126 of the surface mount cap 1113*a* is configured to extend across and under the wedge 1110, and also the panel 1109 when the wedge 1110 is mounted to the panel 11109.

Again, as was previously discussed when referring to FIG. 8B, the wedge wall 1124 may also be provided with an indent or groove which may be V-shaped ("V-groove," "groove," or "indent") 1125 along the length of the wall (as represented by 220 in FIG. 2A). The groove may serve as a guide for a user who needs to drill additional holes for screws, for example, or as a guide for the placement of a screw to be directly drilled in through the wedge when a self-tapping screw is used, for example. The groove may help a drill to be placed at the correct position for the holes. The groove 1125 may be provided along the entire length of the wedge such that when the wedge is cut to a suitable size, the guide for the drill is present even after the wedge is cut.

When using a surface mounting method of installation, a security panel 1109 may be used. Again, as previously described when referring to FIG. 1, the security panel 1109 may be constructed from any suitable material (e.g., polycarbonate, acrylic or similar or a combination of materials) for the security purpose sought (e.g., to prevent break-ins, for bulletproofing, and so on). The wedge 1110 may be secured to the security panel 1109 by any suitable means, such as, for example, weather-sealing tape. A screw or a plurality of screws may also be used to secure the wedge 1110 to the panel 1109. Screw holes may be provided in the wedge 1110, and may be provided every six inches, for example. The screws used for securing the wedge 1110 to the panel 1109 may pass through the wedge, then panel, and the weather-sealing tape, and then finally into the existing window or door frame itself (as will be discussed further when referring to FIGS. 12A-13B). The panel 1109 may then provide additional security and strength to a window, door, glass, or other similar structure that a user wishes to protect.

Next, the surface mount cap 1113*a* may be fitted onto the wedge 1110. When the wedge 1110 and the surface mount cap 1113*a* are assembled together, an open space 1127 may be formed between the return flange 1126 and the bottom end of the wedge 1110. This open space 1127 may be required for the surface mount cap 1113*a* to be inserted onto the wedge 1110, because the surface mount cap 1113*a* may be required to tilt or flex in order to fit into place. Thus, the open space 1127 may allow for the cap 1113*a* to tilt inwards as it is being placed onto the wedge 1110 before being snapped into place. The open space 1127 may allow for the return flange 1126 to tilt or bend as needed for the surface mount cap 1113*a* to fit into place on the wedge 1110, for example.

The surface mount 1113*a* may allow for a flush appearance on the outer surface of the door or window being protected by the security panel framing system. The cap, including the return flange 1126, may also be advantageous in providing a flush and finished appearance to the installed system, by covering any screws that are used for installing the system. Another advantage may be that less materials may be needed for the surface mounting method of installation, wherein a base (such as the base shown and described when referring to FIG. 1) may not be needed.

Additionally, the surface mount system may allow for a user to easily remove components should replacement, cleaning, or servicing be required, without damaging any parts or components in the process of removal. The surface mount cap 1113*a* may, for example, be easily removed from the wedge 1110 by pulling the cap from the wedge.

The surface mount cap 1113*a* may, for example, be low-profile anodized or power-coated aluminum. Similarly, the panel 11109 may be provided in various anodized or powder-coated colors. These options may help for the security panel system to blend in with existing structures, for example.

Figure 12A:
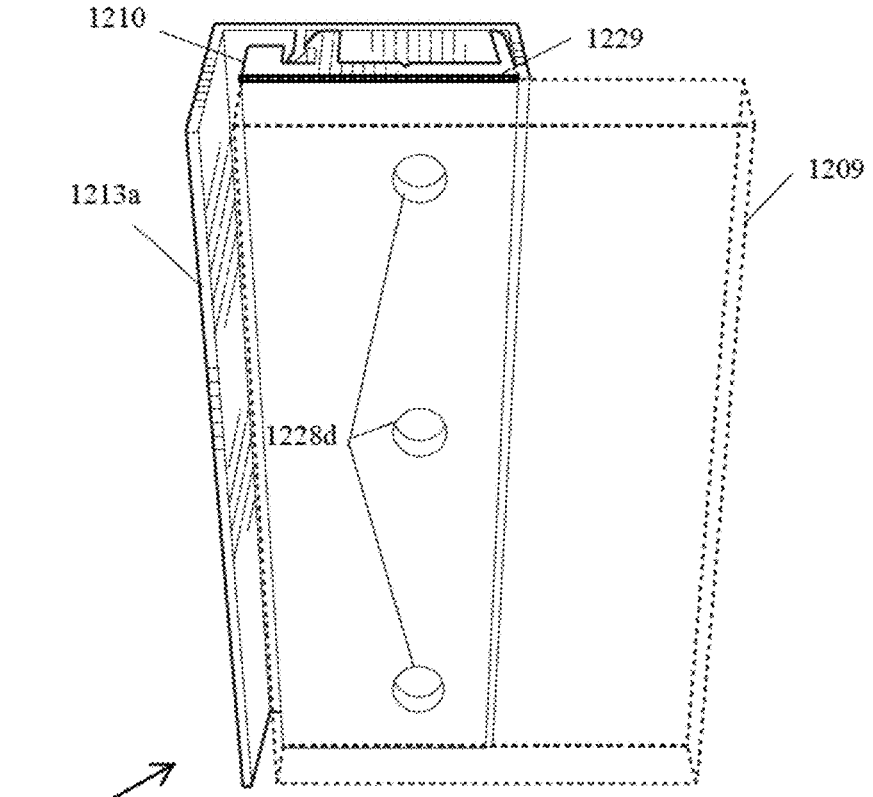
FIGS. 12A-12B illustrate rear perspective views of the security panel framing system, shown with provided screw holes, and shown with screws installed into the provided screw holes, respectively, according to an aspect.
Figure 12B:
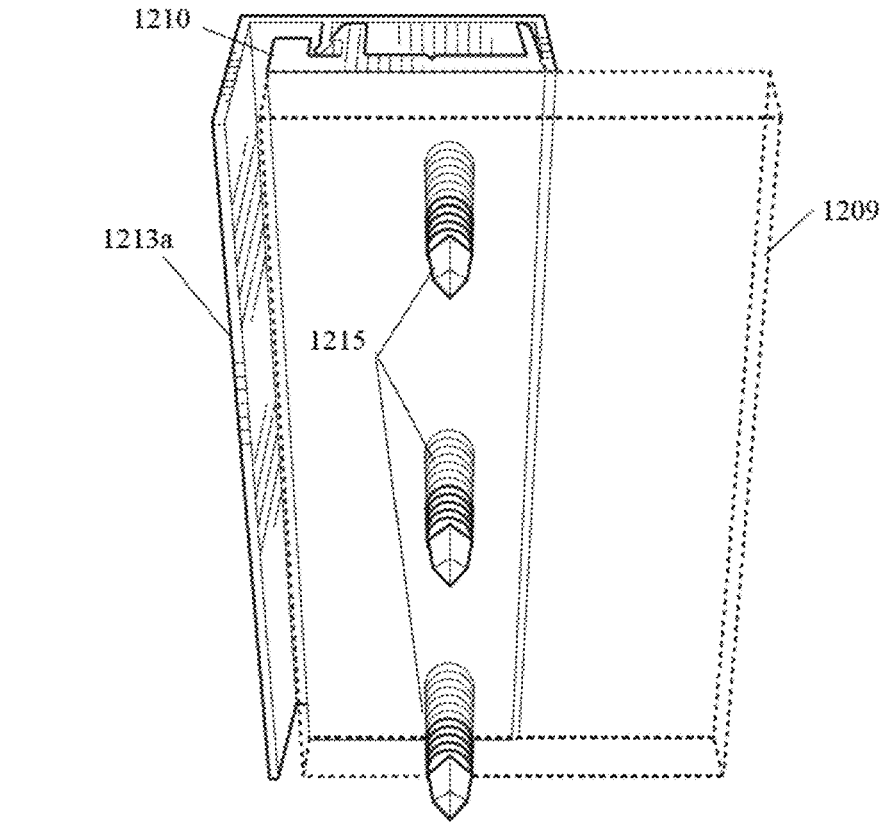

FIGS. 12A-12B illustrate rear perspective views of the security panel framing system 1200*a* of FIG. 11A-11B, shown with provided screw holes 1228*d*, and shown with screws 215 installed into the provided screw holes 1228*d*, respectively, according to an aspect. As was previously discussed when referring to FIG. 1, a screw or a plurality of screws 1215 may be used for further securement of the surface mount security panel framing system 1200*a* onto the surface of a panel 1208, which may be used for providing protection to an existing glass panel, for example. Screws 1215 may, for example, be self-tapping screws, which may be directly drilled or screwed into the various components of the security panel framing system 1200*a*, such as into the wedge 1210, and into the panel 1209. Screw holes 1228*d* may be provided in the security panel framing system 1200*a*. A set of screw holes 1228*d* may be provided in the panel 1209, and a set of screw holes 1228*e* may be provided in the wedge wall (shown in further detail in FIG. 13A). Again, the cap 1213*a* may obscure or cover the screws 1215 from the front side once installed, as shown in FIG. 12B. It should be understood that a security panel framing system 1200*a* may be provided with screws such as screws 1215 only, or with screws 1215 together with screw holes.

Weather sealing tape may be used for further securement of the wedge 1210 to the panel 1209, where shown by 1229 in FIG. 12A (not shown in FIGS. 12B-13B). It should be understood that weather sealing tape 1229 or any other securing means, or any combination of securing means may be used for securing the wedge 1210 to the panel 1209.

Figure 13A:
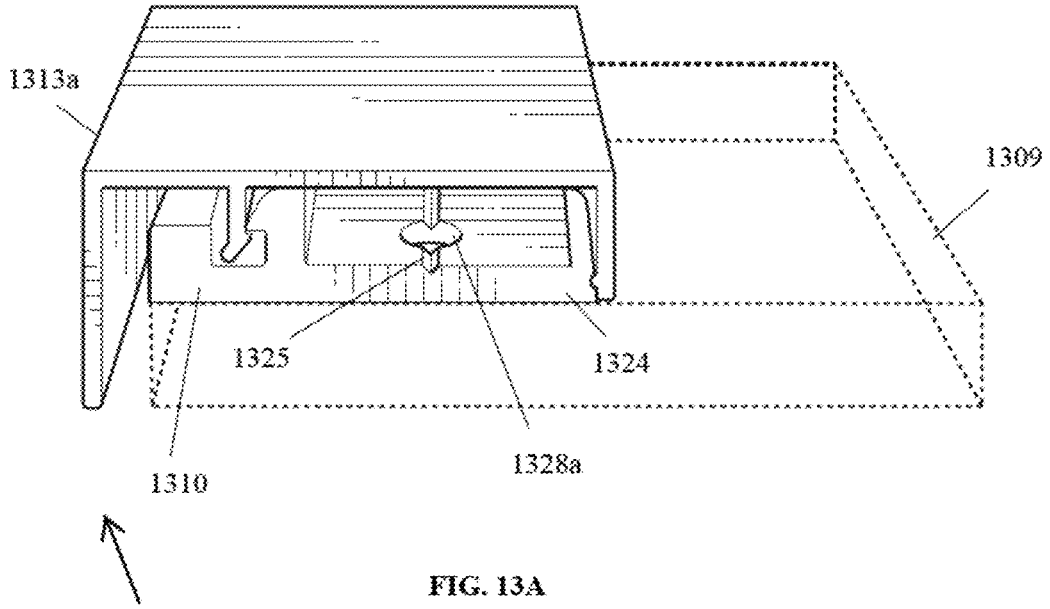
FIGS. 13A-13B illustrate side perspective views of the security panel framing system, shown with provided screw holes, and shown with screws installed into the provided screw holes, respectively, according to an aspect.
Figure 13B:
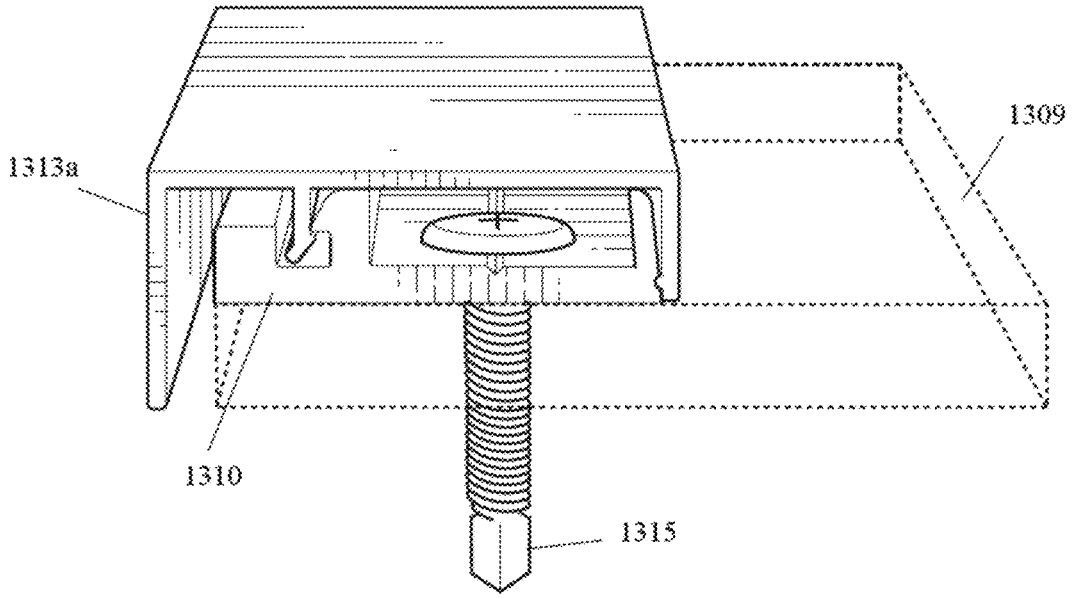

FIGS. 13A-13B illustrate side perspective views of the security panel framing system 1300*a* of FIG. 11A-11B, shown with provided screw holes 1328*a*, and shown with screws 1315 installed into the provided screw holes 1328*a*, respectively, according to an aspect. Again, as was previously discussed when referring to FIG. 12A, a set of screw holes 1328*a* may be provided in the wedge wall 1324 of the wedge 1310. Again, it should be understood that a surface mounted security panel framing system 1300*a* may be provided with screws such as screws 1315 only, or with screws 1315 together with screw holes 1328*a*. A V-groove 1325 may assist a user in finding an appropriate or desired position for placing a self-tapping screw and subsequently drilling a hole, when a screw hole such as screw hole 1328*a* is not provided on the wedge 1310. The screw may be placed on the wedge wall 1324 on the V-groove 1325, and next screwed or drilled through the wedge 1310 and next through the panel 1309.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. As used in this application, "and/or" means that the listed items are alternatives, but the alternatives also include any combination of the listed items.

The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. The terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases.

Acts, elements and features discussed only in connection with one aspect, embodiment or example are not intended to be excluded from a similar role(s) in other aspects, embodiments or examples.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A security panel framing system adapted to be mounted onto a surface of a frame having a glass, the security panel framing system comprising:

a security panel having:

a security panel front side;

a security panel rear side;

a security panel top side; and a security panel bottom side;

a wedge having:

a wedge front side, a wedge back side, a wedge top side, and a wedge bottom side;

an upper wedge lip at the wedge top side;

a wedge wall extending between the wedge top side and the wedge bottom side;

a reinforced wedge end at the wedge bottom side; and a lower wedge lip above the reinforced wedge end;

wherein the wedge back side is adapted to be associated with the security panel front side;

a cap adapted to be associated with the wedge front side, the cap having:

a cap top side;

a cap bottom side;

a cap front side;

a cap rear side;

a first prong extending outwards from the cap rear side at the cap top side, the first prong being adapted to fit onto the upper wedge lip along the wedge top side, and the first prong having a first length;

a second prong adapted to fit between the lower wedge lip and the reinforced wedge end, the second prong having a second length; and a return flange extending outwards from the cap rear side at the cap bottom side, the return flange having a third length, wherein the third length is longer than the first length and the second length;

wherein the security panel framing system is assembled together when the wedge back side is associated with the security panel front side, and the cap is associated with the wedge front side;

such that the return flange extends underneath the wedge bottom side and the security panel bottom side;

such that an open space is created between the return flange and the wedge bottom side together with the security panel;

such that the wedge front side is covered by the cap when the cap is associated with the wedge; and such that the security panel is adapted to be mounted to the frame and to protect the glass within the frame.

2. The security panel framing system of claim 1, further comprising:

a plurality of screws;

wherein the plurality of screws is installed through the wedge wall, the security panel, and into the frame.

3. The security panel framing system of claim 1, the first prong further comprising a bead along the cap bottom side of the first prong; and the upper wedge lip further comprising a notch configured to receive the bead such that the cap is locked onto the wedge.

4. The security panel framing system of claim 1, the wedge wall further comprising a groove extending along a length of the wedge, and the groove being positioned at a midpoint between the upper wedge lip and the lower wedge lip.

5. The security panel framing system of claim 4, the groove further comprising a plurality of screw holes.

6. The security panel framing system of claim 1, wherein the security panel framing system is constructed from anodized aluminum.

7. The security panel framing system of claim 1, wherein an association between the security panel and the wedge is created via weather sealing tape.

8. A security panel framing system adapted to be mounted onto a surface of a frame having a glass, the security panel framing system comprising:

a wedge having:

a wedge front side, a wedge back side, a wedge top side, and a wedge bottom side;

an upper wedge lip at the wedge top side;

a wedge wall extending between the wedge top side and the wedge bottom side;

a reinforced wedge end at the wedge bottom side; and a lower wedge lip above the reinforced wedge end;

a cap adapted to be associated with the wedge front side, the cap having:

a cap top side;

a cap bottom side;

a cap front side;

a cap rear side;

a first prong extending outwards from the cap rear side at the cap top side, the first prong being adapted to fit onto the upper wedge lip along the wedge top side, and the first prong having a first length;

a second prong adapted to fit between the lower wedge lip and the reinforced wedge end, the second prong having a second length; and a return flange extending outwards from the cap rear side at the cap bottom side, the return flange having a third length, wherein the third length is longer than the first length and the second length;

wherein the security panel framing system is assembled together when the cap is associated with the wedge front side;

such that the return flange extends underneath the wedge bottom side;

such that an open space is created between the return flange and the wedge bottom side;

such that the wedge front side is covered by the cap when the cap is associated with the wedge;

such that the wedge is adapted to be associated with a security panel mounted to the frame; and such that the security panel can protect the glass within the frame.

9. The security panel framing system of claim 8, further comprising:

a plurality of screws;

wherein the plurality of screws is installed through the wedge wall, the security panel, and into the frame.

10. The security panel framing system of claim 8, the first prong further comprising a bead along the cap bottom side of the first prong; and the upper wedge lip further comprising a notch configured to receive the bead such that the cap is locked onto the wedge.

11. The security panel framing system of claim 8, the wedge wall further comprising a groove extending along a length of the wedge, and the groove being positioned at a midpoint between the upper wedge lip and the lower wedge lip.

12. The security panel framing system of claim 11, the groove further comprising a plurality of screw holes.

13. The security panel framing system of claim 8, wherein the security panel framing system is constructed from anodized aluminum.

14. The security panel framing system of claim 8, wherein an association between the security panel and the wedge is created via weather sealing tape.

15. A method of installing a security panel on a frame for a glass, using a security panel framing system comprising:

a security panel having:

a security panel front side;

a security panel rear side;

a security panel top side; and a security panel bottom side;

a wedge having:

a wedge front side, a wedge back side, a wedge top side, and a wedge bottom side;

an upper wedge lip at the wedge top side;

a wedge wall extending between the wedge top side and the wedge bottom side;

a reinforced wedge end at the wedge bottom side; and a lower wedge lip above the reinforced wedge end;

wherein the wedge back side is adapted to be associated with the security panel front side;

a cap adapted to be associated with the wedge front side, the cap having:

a cap top side;

a cap bottom side;

a cap front side;

a cap rear side;

a first prong extending outwards from the cap rear side at the cap top side, the first prong being adapted to fit onto the upper wedge lip along the wedge top side, and the first prong having a first length;

a second prong adapted to fit between the lower wedge lip and the reinforced wedge end, the second prong having a second length; and a return flange extending outwards from the cap rear side at the cap bottom side, the return flange having a third length, wherein the third length is longer than the first length and the second length;

wherein the security panel framing system is assembled together when the wedge back side is associated with the security panel front side, and the cap is associated with the wedge front side;

such that the return flange extends underneath the wedge bottom side and the security panel bottom side;

such that an open space is created between the return flange and the wedge bottom side together with the security panel;

such that the wedge front side is covered by the cap when the cap is associated with the wedge; and such that the security panel is mounted to the frame and protects the glass within the frame;

the method comprising the steps of:

associating the wedge with the security panel via weather sealing tape;

placing the security panel rear side on the frame;

attaching the security panel to the frame;

placing the cap onto the wedge front side;

holding the cap against the wedge; and pushing a force on the cap to associate the cap with the wedge.

16. The method of claim 15, the security panel framing system further comprising:

a plurality of screws;

wherein the attaching step is performed by screwing in the plurality of screws through the wedge wall, the security panel, and into the frame.

17. The method of claim 15, further comprising repeating the steps such that a second wedge and a second cap are installed on the security panel.

18. The security panel framing system of claim 15, the first prong further comprising a bead along the cap bottom side of the first prong; and the upper wedge lip further comprising a notch configured to receive the bead such that the cap is locked onto the wedge.

19. The security panel framing system of claim 15, the wedge wall further comprising a groove extending along a length of the wedge, and the groove being positioned at a midpoint between the upper wedge lip and the lower wedge lip.

20. The security panel framing system of claim 19, the groove further comprising a plurality of screw holes.

* * * * *